US012031468B2

(12) United States Patent
Bostick et al.

(10) Patent No.: US 12,031,468 B2
(45) **Date of Patent: *Jul. 9, 2024**

(54) SYSTEM AND METHOD FOR TREATING GAS TURBINE EXHAUST GAS

(71) Applicant: Nooter/Eriksen, Inc., Fenton, MO (US)

(72) Inventors: Glen L. Bostick, Columbia, IL (US); Shaun P. Hennessey, St. Charles, MO (US); Nathan Ross, Ballwin, MO (US); Piero Scapini, Milan (IT)

(73) Assignee: Nooter/Eriksen, Inc., Fenton, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/205,959

(22) Filed: Jun. 5, 2023

(65) Prior Publication Data

US 2023/0332526 A1 Oct. 19, 2023

Related U.S. Application Data

(63) Continuation-in-part of application No. 17/487,887, filed on Sep. 28, 2021, now Pat. No. 11,668,219.
(Continued)

(51) Int. Cl.
*F01N 3/20* (2006.01)
*F01N 3/02* (2006.01)
(Continued)

(52) U.S. Cl.
CPC ..... *F01N 3/2006* (2013.01); *F01N 3/0205* (2013.01); *F01N 3/02* (2013.01); *F01N 3/0234* (2013.01); *F01N 3/04* (2013.01); *F01N 3/2889* (2013.01); *F01N 5/02* (2013.01); *F01N 2240/02* (2013.01); *F01N 2240/10* (2013.01); *F01N 2260/02* (2013.01); *F01N 2260/024* (2013.01); *F28D 21/0001* (2013.01); *F28D 21/0003* (2013.01); *F28F 9/26* (2013.01)

(58) Field of Classification Search
CPC combination set(s) only.
See application file for complete search history.

(56) References Cited

U.S. PATENT DOCUMENTS 5,352,272 A 10/1994 Moll et al.
8,046,989 B2 11/2011 VanderGriend et al.
(Continued)

*Primary Examiner* — Binh Q Tran
(74) *Attorney, Agent, or Firm* — Sandberg Phoenix & von Gontard, P.C.

(57) ABSTRACT

A system and method for treating turbine exhaust gas includes an exhaust gas discharge structure, a catalytic exhaust gas treatment device, at least two heat exchangers and a district heating system. The catalytic exhaust gas treatment device is positioned at least partially within the exhaust gas discharge structure. A first heat exchanger is positioned at least partially within the exhaust gas discharge structure and upstream of the catalytic exhaust gas treatment device to remove heat from an exhaust gas by transferring heat to a working fluid. A second heat exchanger is positioned at least partially within the exhaust gas discharge structure downstream of the catalytic exhaust gas treatment device to remove heat from the exhaust gas that has passed though the device by transferring heat to the working fluid. A pump drives the working fluid between the first heat exchanger, the district heating system and the second heat exchanger.

26 Claims, 10 Drawing Sheets

Related U.S. Application Data

(60) Provisional application No. 63/084,290, filed on Sep. 28, 2020.

(51) Int. Cl.

| | |
|---|---|
| ***F01N 3/023*** | (2006.01) |
| ***F01N 3/04*** | (2006.01) |
| ***F01N 3/28*** | (2006.01) |
| ***F01N 5/02*** | (2006.01) |
| ***F28D 21/00*** | (2006.01) |
| ***F28F 9/26*** | (2006.01) |

(56) References Cited

U.S. PATENT DOCUMENTS

| | | | | |
|---|---|---|---|---|
| 8,062,617 | B2 | 11/2011 | Stakhev et al. | |
| 8,166,752 | B2 | 5/2012 | Garcia et al. | |
| 8,479,501 | B2 | 7/2013 | McCarthy, Jr. | |
| 9,109,532 | B2 * | 8/2015 | Geskes | F01K 9/003 |
| 9,512,759 | B2 | 12/2016 | Muthaiah et al. | |
| 9,915,200 | B2 | 3/2018 | Minto et al. | |
| 10,107,495 | B2 | 10/2018 | Minto | |
| 11,668,219 | B2 * | 6/2023 | Bostick | F01N 3/2073 60/320 |
| 2005/0000473 | A1 * | 1/2005 | Ap | F01P 7/165 123/41.31 |
| 2008/0302519 | A1 | 12/2008 | Franklin et al. | |
| 2011/0083426 | A1 * | 4/2011 | Ikemoto | F01P 7/165 60/297 |
| 2011/0131962 | A1 | 6/2011 | Toi et al. | |
| 2012/0036850 | A1 | 2/2012 | Ernst et al. | |
| 2014/0352279 | A1 * | 12/2014 | Gonze | F01N 3/2046 60/274 |
| 2015/0013328 | A1 * | 1/2015 | Carstensen | F02B 47/08 60/597 |
| 2015/0376801 | A1 | 12/2015 | Bairamijamal | |
| 2017/0159542 | A1 * | 6/2017 | Bilancia | F01P 3/20 |
| 2017/0350320 | A1 | 12/2017 | Kippel et al. | |
| 2017/0356386 | A1 | 12/2017 | Hombsch et al. | |
| 2018/0238220 | A1 | 8/2018 | Itou et al. | |
| 2019/0264580 | A1 * | 8/2019 | Zuschlag | F02G 5/02 |
| 2019/0276757 | A1 | 9/2019 | Liss et al. | |

* cited by examiner

SYSTEM AND METHOD FOR TREATING GAS TURBINE EXHAUST GAS

CROSS-REFERENCE TO RELATED APPLICATIONS

This application is a Continuation-In-Part of U.S. patent application Ser. No. 17/487,887, filed Sep. 28, 2021, claims the benefit of U.S. Provisional Patent Application Ser. No. 63/084,290, filed Sep. 28, 2020, both of which are hereby incorporated herein by reference in their entireties.

STATEMENT REGARDING FEDERALLY SPONSORED RESEARCH OR DEVELOPMENT

Not Applicable.

BACKGROUND OF THE DISCLOSURE

Exhaust gases from a variety of processes and/or combustion of a variety of fuels typically include one or more harmful substances such as carbon monoxide and/or nitrogen oxide. For example, combustion of natural gas or other fossil fuels in power plants generates a hot exhaust gas stream including carbon monoxide, nitrogen oxides, and/or other exhaust gases. Chemical production, hydrocarbon cracking, steel production, and other processes similarly generate a hot exhaust gas stream including harmful substances. Typically, an exhaust gas stream is treated with one or more catalysts (e.g., in a catalyst bed) to mitigate carbon monoxide, nitrogen dioxide, and/or other substances. For example, catalysts can be used to convert nitrogen dioxide and/or carbon monoxide to one or more of water, diatomic nitrogen, carbon dioxide, and/or other less harmful compounds. To treat nitrogen oxides using a catalyst, typically a reactant is used such as anhydrous ammonia or an aqueous solution of ammonia that is introduced upstream of a selective catalytic reaction (SCR) catalyst.

Each catalyst and/or reactant has an operating temperature range that optimizes the desired reaction to mitigate components of the exhaust gas. Additionally, the catalyst or reactant itself and/or the housing (e.g., SCR) or material containing the catalyst and/or reactant can be damaged if the temperature of the exhaust gas exceeds the mechanical/chemical design limits for the catalyst or housing. Therefore, it is sometimes advantageous to controllably reduce the temperature of the exhaust gas prior to passing the exhaust gas into the catalyst materials such that the exhaust gas is within a temperature range for optimum treatment of certain components within the exhaust gas.

Many existing exhaust gas cooling systems and exhaust treatment systems suffer from poor performance, lifespan, efficiency and the like due to the limitations of cooling systems and the requirements of the exhaust treatment systems described above.

SUMMARY OF THE PRESENT DISCLOSURE

The cooling system described in the present disclosure provides several advantages over the typical gas turbine exhaust gas treatment system. Through use of disclosed system to cool gas turbine exhaust gas, the turbine exhaust gas temperature is controllable to be within the range for treatment with one or more catalysts (e.g., catalyst treatment of carbon monoxide, selective catalytic reduction, SCR, treatment of nitrogen oxides, etc.). Cooling the turbine exhaust allows for the removal of the typical equipment used in treatment, such as forced draft fans, induced draft fans and direct water injection. Exhaust fans are typically energy inefficient and water injection, which has the costs associated with a certain degree of chemical treatment, can lead to formation of undesirable aerosols, premature corrosion of components, and poor performance of the emission catalyst. Preprocessing the turbine exhaust gas to lower the temperature using a system of the type described herein is more energy efficient than using forced draft or induced draft fans generally due to the power consumption associated with moving air (e.g., with a blower, fan, compressor or the like) in comparison to the lesser energy consumption of circulating a liquid (e.g., with a pump). The disclosed system also forgoes the use of direct injection of water into the exhaust and thus removes the potential negative effects of water injection described above. The use of a working fluid as described herein to cool turbine exhaust gas prior to catalytic treatment also allows for greater control over the temperature of the turbine exhaust gas at one or more positions. For example, a working fluid can be used to control the turbine exhaust gas temperature prior to treatment for carbon monoxide at a first location and within a first temperature range, and the temperature of the turbine exhaust gas can be controlled at a second location prior to treatment for nitrous oxides and within a second, different temperature range. Controllability allows for the optimum temperature for different catalytic reactions.

Thus, the controllability provided by the use of a working fluid to cool turbine exhaust gas allows for a decrease in energy consumption in comparison to the use of other techniques (e.g., forced induction fans), and the use of controllable cooling by a working fluid allows for optimization of the catalytic reactions used to treat the turbine exhaust gas. These advantages of the presently described turbine exhaust gas treatment system allow for these and/or other benefits. Use of a working fluid to cool turbine exhaust gas also provides an advantage in that the heat of the turbine exhaust gas can be removed and captured by the working fluid. The energy removed from the turbine exhaust gas can be recovered directly by a mechanical connection to a device such as a pump (e.g., the pump being driven by the working fluid), indirectly using expansion through a suitable device connected to an electrical generator (e.g., the working fluid driving an energy recovery turbine coupled to a generator), or the heat recovered by the working fluid can be used to heat up a separate process fluid (e.g., using a heat exchanger to transfer heat from the working fluid to the separate process fluid).

In another embodiment of the disclosure, in a gas turbine exhaust gas treatment system described herein, a first heat exchanger is positioned in the flow path of exhaust gas from a gas turbine and in front of a catalytic converter such as a Selective Catalytic Reducer (SCR). The first heat exchanger is operable to control the turbine exhaust gas temperature and cool the turbine exhaust gas temperature to be within the range for treatment with one or more catalysts of the SCR. The working fluid cycled through the first heat exchanger cools the turbine exhaust gas and allows for greater control over the temperature of the turbine exhaust gas prior to catalytic treatment as the exhaust gas flows through the SCR.

The working fluid heated by the turbine exhaust gas passing through the first heat exchanger is delivered from the first heat exchanger to a system for distributing the heat of the working fluid, for example district heating or heat networks for general use.

On exiting the district heating, the working fluid is then delivered through a pump to a second heat exchanger positioned in the flow path of the turbine exhaust gas exiting the SCR. The second heat exchanger recovers some final residual heat from the turbine exhaust gas exiting the SCR and further cools the exhaust gas and then directs the working fluid back to the first heat exchanger.

Other benefits and features of the cooling system of the present disclosure will be apparent in view of the disclosed hereinafter.

BRIEF DESCRIPTION OF THE DRAWINGS

Corresponding reference characters and symbols indicate corresponding parts throughout the several views of the drawings.

DETAILED DESCRIPTION

Figure 1:
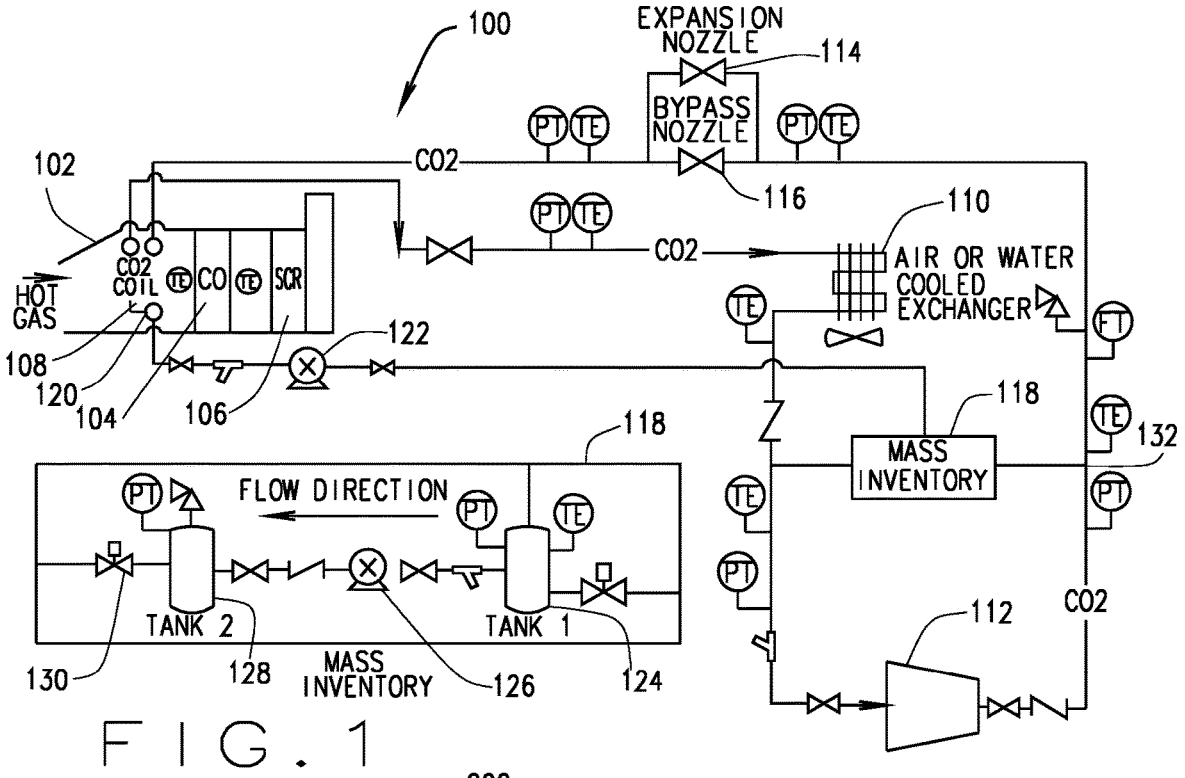
FIG. 1 is a schematic view of a gas turbine exhaust gas treatment system including catalytic treatment devices and a carbon dioxide cooling system for cooling turbine exhaust gas, with an expanded view of the mass inventory management system shown to the lower left.

The following detailed description illustrates the disclosed turbine exhaust gas treatment system and associated methods by way of example and not by way of limitation. The description enables one of ordinary skill in the relevant art to which this disclosure pertains to make and use the turbine exhaust gas treatment system. This detailed description describes several embodiments, adaptations, variations, alternatives, and uses of the turbine exhaust gas treatment system, including what is presently believed to be the best mode of implementing the claimed turbine exhaust gas treatment system and associated methods. Additionally, it is to be understood that the disclosed turbine exhaust gas treatment system is not limited in its application to the details of construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting.

Referring generally to FIGS. 1-8, the turbine exhaust gas treatment system uses a working fluid to treat turbine exhaust gas. While the exhaust gas treatment system can be considered for any process requiring emissions reduction, one application is related to simple cycle gas turbine facilities. However, exhaust gas resulting from combustion associated with a simple cycle gas turbine facility is only one example of exhaust gas. As used herein, the terms "turbine exhaust gas" and "process turbine exhaust gas" should be understood to be gas from or related to any process such as combustion (e.g., related to power production), chemical production, oil cracking, steel production, or other process that uses or produces as a byproduct a turbine exhaust gas. Referring again to a simple cycle turbine facility, such facilities use only a singular thermodynamic cycle (e.g., Brayton cycle) employed such that the hot exhaust gases from the gas turbine are vented directly to the atmosphere. If emission reductions are required in a simple cycle plant, often large forced draft fans are used to mix large amounts of ambient air with the gas turbine exhaust to achieve the required catalysts operating temperatures. These fans are often expensive to procure and generally have high operating costs (e.g., electrical consumption is high).

The exhaust gas treatment system cools high temperature turbine exhaust gases to optimum temperature ranges to promote the desired chemical reactions that take place to treat exhaust components while simultaneously protecting the catalyst systems from suffering mechanical damage due to overheating. This is achieved without use of large forced draft fans or induced draft fans. No additional atmosphere or other gases need be added to the turbine exhaust gas, for the purpose of cooling the turbine exhaust gasses, before the turbine exhaust gas is treated with one or more catalytic processes. In some embodiments, additional atmosphere or other gases are added indirectly to the turbine exhaust gases, but this is not to cool the turbine exhaust gases but is rather to facilitate the treatment of the turbine exhaust gases. For example, when treating nitrogen oxides of the turbine exhaust gas stream ammonia can be used. In such a case, the ammonia can be aqueous such that the ammonia is mixed with atmospheric air in a mixing tank where the aqueous ammonia is flashed into and diluted with the atmosphere in the mixing tank prior to injection into the turbine exhaust gas.

A heat transfer coil upstream of the catalyst system(s) is used to treat the turbine exhaust gas to reduce the hot gas temperature to targeted ranges for safer and more efficient catalyst operation. The recovered heat removed from the hot turbine exhaust gas is dissipated to ambient via air and/or water-cooled heat exchangers. Alternatively, the removed heat can be used to heat up external process streams (e.g., using a heat exchanger), recovered by mechanical application (e.g. the removed heat can drive a pump), or the removed heat can be recovered through direct expansion of the thermal working fluid using a device connected to an electrical generator (e.g., the thermal fluid can be expanded to drive a turbine which in turn drives an electrical generator). Additional heat transfer coils can be positioned within the gas stream to allow different turbine exhaust gas temperatures to be achieved at different points within the turbine exhaust gas stream.

This temperature control allows for improved treatment of the turbine exhaust gas. For example, typically the targeted optimum temperature range for the carbon monoxide treating catalysts does not overlap with the optimum temperature range for the nitrogen oxides treatment reactions. The temperatures for treating carbon monoxide are higher than the temperatures for treating nitrogen oxides. As a result, the carbon monoxide treatment catalyst can operate in a hotter temperature range, below an upper limit, than the SCR catalyst. The use of multiple cooling coils (e.g., heat exchangers) allows for the temperature of the turbine exhaust gas stream to be controlled to improve the effectiveness of the catalytic treatment.

In some embodiments of the turbine exhaust gas treatment system, the system uses supercritical carbon dioxide as the working fluid. This provides some specific advantages in that supercritical carbon dioxide has a high fluid density making it easy to pump around a closed cooling loop and a high heat capacity such that the system can use a lower amount of fluid passing through the heat exchanger coil for the same temperature reduction of hot turbine exhaust gas. Other suitable heat transfer working fluids including, but not limited to, thermal oils and/or water can be utilized in other embodiments of the turbine exhaust gas treatment system. The system uses cooling loops to cool the turbine exhaust gas stream to be treated. It should be understood that "cooling loop" used herein refers to the equipment used in a refrigeration cycle to provide a cooled working fluid to a heat exchanger to cool the turbine exhaust gas or any other gas to be treated. For example, the cooling loop can include piping, conduits, or the like to contain and allow for the transfer of working fluid; a condenser; a pump; an expansion nozzle; an evaporator; and/or other components (e.g., a shared or dedicated mass inventory system) to provide for a refrigeration cycle for cooling the turbine exhaust gas to be treated. The piping, conduits, or the like provide for fluid communication of the working fluid between the other components of the cooling loop.

Referring now to FIG. 1, one embodiment of the system 100 for treating turbine exhaust gas using a carbon dioxide working fluid is shown. Exhaust gas to be treated (e.g., from a gas turbine or other process) is received by a turbine exhaust gas discharge structure 102. The turbine exhaust gas discharge structure 102 is adapted and configured to receive turbine exhaust gas from a source (e.g., gas turbine) and pass the turbine exhaust gas through the turbine exhaust gas discharge structure 102. For example, the turbine exhaust gas discharge structure 102 can be hard piped to a turbine exhaust source and can be or include a pipe, duct, or other structure.

The turbine exhaust gas passing through the turbine exhaust gas discharge structure 102 passes over/through a catalytic turbine exhaust gas treatment device 104. The catalytic turbine exhaust gas treatment device 104 is positioned at least partially within the turbine exhaust gas discharge structure 102 such that turbine exhaust gas comes into contact with the catalytic exhaust gas treatment device 104. The catalytic exhaust gas treatment device 104 is adapted and configured to treat at least one component of the turbine exhaust gas through a catalytic reaction between a catalyst contained within the catalytic exhaust gas treatment device 104 and the at least one component of the turbine exhaust gas. For example, the catalytic exhaust gas treatment device 104 contains any suitable agent to react with carbon monoxide to form carbon dioxide. For example, carbon monoxide can be treated using platinum, rhodium, palladium, oxidizers generally, or any other suitable catalyst(s).

The system 100 can further include a second catalytic turbine exhaust gas treatment device 106 positioned within the turbine exhaust gas discharge structure 102 and downstream of the first catalytic turbine exhaust gas treatment device 104. The second catalytic turbine exhaust gas treatment device 106 is adapted and configured to treat at least one component of the turbine exhaust gas through a catalytic reaction between a catalyst contained within the second catalytic turbine exhaust gas treatment device 106 and the at least one component of the turbine exhaust gas. For example, the second catalytic exhaust gas treatment device 106 contains any suitable agent to react with nitrogen oxides to form one or more of water, diatomic nitrogen, or other compounds. The agent can be or include a reactant such as anhydrous ammonia, an aqueous solution of ammonia, or the like.

In some embodiments, the first catalytic turbine exhaust gas treatment device 104 is adapted and configured to treat both carbon monoxide and nitrogen oxides within the turbine exhaust gas. The first catalytic turbine exhaust gas treatment device 104 can treat both carbon monoxide and nitrogen oxides using multiple catalysts or a single catalyst. For example, in the case of a single catalyst, the first catalytic turbine exhaust gas treatment device 104 can include iron and cobalt impregnated over activated semi-coke. The catalyst is fed with carbon monoxide (e.g., from the turbine exhaust gas) to absorb or otherwise remove nitrogen oxides from the turbine exhaust gas. Other single catalysts can be used to treat both carbon monoxide and nitrogen oxide such as a barium-promoted copper chromite catalyst or any other suitable catalyst.

In order to reduce the temperature of the turbine exhaust gas to within a range suitable for treatment with the catalytic exhaust gas treatment device 104, the system includes a first heat exchanger 108. The first heat exchanger 108 is positioned at least partially within the turbine exhaust gas discharge structure 102 and upstream of the catalytic turbine exhaust gas treatment device 104. The first heat exchanger 108 is adapted and configured to remove heat from turbine exhaust gas passing through the turbine exhaust gas discharge structure 102 by transferring heat to a working fluid (e.g., carbon dioxide) passing through and within the first heat exchanger 108. The working fluid passes through a cooling loop to continuously (e.g., on demand) provide cooling to the turbine exhaust gas during operation of the system 100 for treating turbine exhaust gas. It should also be understood that the turbine exhaust gas can be cooled for a purpose other than improving the treatment of the turbine exhaust gas (e.g., for the reduction in carbon monoxide and/or nitrogen oxides). For example, the turbine exhaust gas can be cooled to maintain the turbine exhaust gas within a specific temperature range irrespective of a temperature range for treating the turbine exhaust gas. This can allow for processing of the turbine exhaust gas into other products or other uses of the turbine exhaust gas.

Cooled working fluid passes through the first heat exchanger 108 and leaves the first heat exchanger 108 with additional heat. The working fluid leaving the first heat exchanger enters a second heat exchanger 110 positioned downstream of the first heat exchanger 108. The second heat exchanger 110 is adapted and configured to remove heat from the working fluid gained at the first heat exchanger 108. The second heat exchanger 110 can be a condenser that facilitates a phase change of the working fluid from a gas or partial gas exiting the first heat exchanger 108 to at least partially a liquid exiting the second heat exchanger 110. This can facilitate pumping of the working fluid. Alternatively, the second heat exchanger 110 simply removes heat from the working fluid.

In some embodiments, the second heat exchanger 110 is an air-cooled heat exchanger, and in other embodiments the second heat exchanger 110 is a water-cooled heat exchanger. The second heat exchanger 110 can include a fan passing air over the second heat exchanger 110. The second heat exchanger 110 can transfer heat to the atmosphere. In some embodiments, the second heat exchanger 110 can be or include a cooling tower or evaporative cooler.

The working fluid (e.g., carbon dioxide) leaving the second heat exchanger 110 is received at a pump 112 positioned downstream of the second heat exchanger 110. The pump 112 is adapted and configured to drive the working fluid through the cooling loop. The pump 112 can be driven by an electric motor such as a variable frequency drive motor. The pump 112 is adapted and configured to pump supercritical carbon dioxide (or any other applicable fluid). In alternative embodiments (described later with reference to other Figures herein), the working fluid can change phases within the cooling loop and the pump 112 can be adapted and configured to pump a mixed phase working fluid. The pump 112 can compress the working fluid or can simply pump the working fluid.

The pump 112 drives the carbon dioxide working fluid through the cooling loop to an expansion nozzle 114. The expansion nozzle 114 is positioned downstream of the pump 112 and upstream of the first heat exchanger 108. The expansion nozzle 114 is adapted and configured to expand the supercritical carbon dioxide working fluid to reduce the temperature of the working fluid prior to the working fluid entering the first heat exchanger 108. The expansion nozzle 114 can be adapted and configured to change the phase of at least a portion of the working fluid. Alternatively, the expansion nozzle 114 expands the working fluid without the working fluid changing phase. The use of the expansion nozzle 114 reduces the temperature of the working fluid such that a lesser amount of working fluid is needed to achieve a targeted gas temperature at the inlet of the catalytic exhaust gas treatment device 104 (in comparison to a system without an expansion nozzle 114). The reduced temperature allows for use of less working fluid.

The system 100 includes a bypass loop which can include a bypass nozzle 116. The bypass loop (which can include a bypass nozzle 116) is adapted and configured to controllably and selectively permit the working fluid to bypass the expansion nozzle 114. The expansion nozzle 114 can be bypassed using the bypass 116 if sufficient cooling is being provided by the second heat exchanger 110 removing heat from the working fluid. For example, the ambient temperature can be sufficiently low that the second heat exchanger 110 provides sufficient cooling of the turbine exhaust gas. Bypassing the expansion nozzle 114 allows the system 100 to avoid or reduce the pressure drop associated with use of the expansion nozzle 114. Bypassing the expansion nozzle 114 and forgoing the associated pressure drop increases efficiency as the energy required to pump the working fluid is reduced when the pressure is maintained.

In embodiments including a bypass nozzle 116, the bypass is adapted and configured to bypass the expansion nozzle 114 such that the working fluid is expanded by the bypass expansion nozzle 116 instead. The bypass nozzle 116 is adapted and configured to expand the working fluid to a lesser degree than the expansion nozzle 114. Alternatively, the bypass nozzle 116 can expand the working fluid to a greater degree than the expansion nozzle 114 such that the expansion nozzle 114 is bypassed when additional cooling is desired to maintain the exhaust gas temperature within a range suitable for treatment as described herein. In another embodiment, the bypass nozzle 116 can be designed so to minimize or reduce expansion of the fluid passing through the bypass. The bypass valve and the expansion nozzle functionally can be a throttling valve or fixed device, and can be manually or automatically actuated.

The system 100 further includes a mass inventory management system 118. The mass inventory management system 118 is adapted and configured to manage the amount of working fluid within the cooling loop that includes the first heat exchanger 108. The mass inventory management system 118, in order to manage the amount of working fluid in the cooling loop, is adapted and configured to controllably receive working fluid from downstream of the first heat exchanger 108. The mass inventory management system 100 is still further adapted and configured to add or remove working fluid from the cooling loop.

The mass inventory management system 118 controllably removes working fluid from downstream of the first heat exchanger 108 (e.g., using a controllable valve) at a takeoff point 120. Working fluid removed from the cooling loop at the takeoff point 120 passes through a valve to a pump 122. The pump 122 drives the working fluid from the takeoff point 120 to the mass inventory management system 118. The working fluid pumped by the pump 122 passes through a further valve on the way to the mass inventory management system 118.

In the expanded schematic of the inventory management system in FIG. 1, the working fluid is received in a first tank 124 of the mass inventory management system 118. The first tank 124 can store the working fluid and/or can function as a temporary receiving tank. The first tank is drainable by a mass inventory pump 126. The working fluid leaving the first tank 124 passes through a check valve positioned between the first tank 124 and the mass inventory pump 126. The mass inventory pump 126 is controllable to supply a second tank 128 of the mass inventory management system 118 with working fluid. The second tank 128 can operate as storage tank for the working fluid. Working fluid driven by the pump 126 passes through a check valve and/or an additional valve on the way to the second tank 128.

A controllable valve 130 (e.g., the valve can be an open/close discrete valve with a generally fixed flow restriction but also can be an active flow control valve with flow controlling characteristic permitting variable flows) is positioned downstream of the second tank 128 to control the addition of working fluid into the cooling loop. The controllable valve 130 is positioned to discharge working fluid from the mass inventory management system 118 into the cooling loop downstream of the second heat exchanger 110 and upstream of the pump 112. The mass inventory management system 118 is also adapted and configured to controllably receive working fluid from the cooling loop at a second takeoff point 132 positioned downstream of the pump 112 and upstream of the expansion nozzle 114.

Still referring to FIG. 1, the system 100 includes a variety of sensors for use in controlling the pumped flow of working fluid to the first heat exchanger 108, the pump 112, the mass inventory management system 118, or the like. Sensors shown in FIG. 1 with the abbreviation PT are or include a pressure transducer adapted and configured to measure the pressure of the working fluid at that point in the system 100. Sensors shown with the abbreviation TE are or include a temperature element (e.g., a thermocouple, thermistor, or the like) adapted and configured to measure the temperature of the working fluid or the temperature of the turbine exhaust gas in the system 100. Sensors shown with the abbreviation FT are or include a flow transmitter/flow meter (e.g., an anemometer, magnetic flow meter, turbine flow meter, rotameter, spring and piston flow meter, or the like). The system 100 can also employ additional and/or different types of process measurements to control the system and/or provide process conditions for data collection and system optimization.

Using these sensors and controllable devices (e.g., valves), the system 100 is controlled in operation. The system 100 is primarily controlled based on the turbine exhaust gas temperature entering the catalytic turbine exhaust gas treatment device 104 located within the hot turbine exhaust gas stream and within the turbine exhaust gas discharge structure 102. The system can also or alternatively be controlled based on the turbine exhaust gas temperature entering the second catalytic turbine exhaust gas treatment device 106. The set point temperature for the hot turbine exhaust gas temperature at the catalyst face (e.g., at the entrance to the first and/or second catalytic turbine exhaust gas treatment device) is used to modulate the variable frequency drive motor driving the pump 112. This in turn controls the flow rate of the working fluid around the cooling loop with more flow being provided when the turbine exhaust temperature at the catalyst face is hotter than the set point. In alternative embodiments, the pump 112 is not driven by a variable frequency drive motor and instead a flow control valve is positioned downstream of the pump 112. Such a flow control valve is used to control the flowrate of the working fluid through the cooling loop to in turn control the temperature of the turbine exhaust gas.

In some embodiments, the system 100 is controlled by having a flow rate set by controlling the turbine exhaust gas temperature at the face of the catalytic turbine exhaust gas treatment device 104 with the working fluid passing through the bypass valve 116. When the pump flow rate reaches a predetermined level, the flow can be modulated through the bypass valve 116 so as to control the temperature of the turbine exhaust gases at the face of the catalytic turbine exhaust gas treatment device 104.

In embodiments of the system 100 including a heat exchanger utilizing a fan (e.g., the second heat exchanger 110), the sequencing of the fan ON/OFF within the heat exchanger can be used to optimize or reduce power consumption and/or for further temperature control of the working fluid. For example, on colder days it is possible to turn off the fan(s) as the working fluid temperature can be suitably low enough to achieve the desired turbine exhaust gas temperature at the face of the catalyst. Additionally, in some embodiments one or more heat exchangers can be bypassed, in full or in part, and any corresponding fan can be cycled down. Selectively bypassing one or more ambient air heat exchangers allows for further temperature control of the working fluid prior to entering the heat exchanger 108 located in the hot turbine exhaust gas stream. Bypassing one or more ambient air heat exchangers also allows for a reduction in power consumption by the pump 112 due to a lower total pressure drop for the closed working fluid loop flow path.

For applications using CO2 (e.g., system 100 shown in FIG. 1), the mass inventory management system 118 can be operated to maintain the CO2 working fluid in the supercritical state (T>32° C., 77 bar) or in the liquid state throughout the complete working loop. However, it should also be understood that the use of an expansion valve/nozzle 114 can result in a 2-phase fluid including vapor being introduced to the first heat exchanger 108 (e.g., a transfer coil inside the hot gas stream). With CO2 working fluid, the mass inventory management system 118 is controlled based on the temperature at the inlet to the pump 112 and is controlled to manage the pressure at this location by adding or subtracting mass from the closed cooling loop system to ensure that the fluid state at the inlet of the pump 112 is either supercritical (hotter ambient days, typically T>28° C.) or liquid phase (cooler ambient days, typically T<28° C.).

Referring now generally to FIGS. 2-8, different embodiments of the system 100 are shown and are later described. Components shown similarly to those in FIG. 1 are the same or substantially similar unless otherwise described as follows. For example, in FIG. 2 the first heat exchanger 208 is the same as the first heat exchanger 108 described with reference to FIG. 1.

Figure 2:
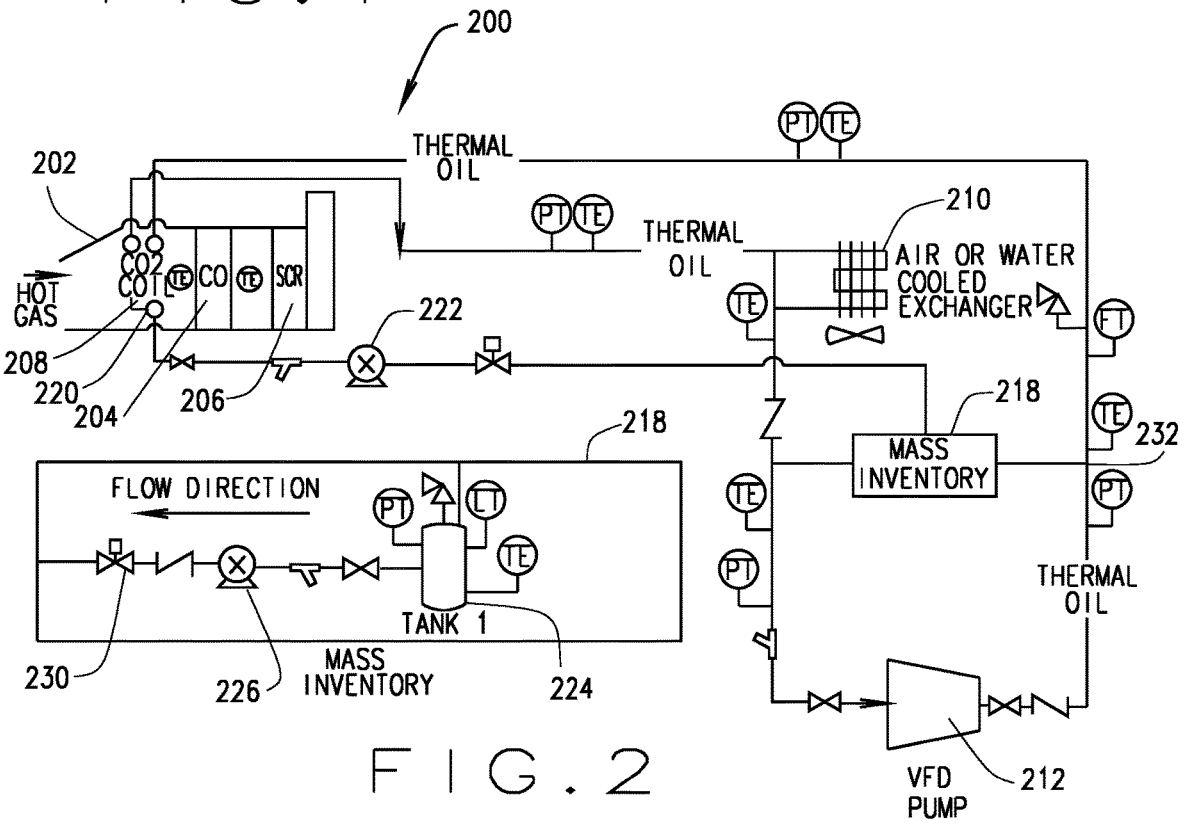
FIG. 2 is a schematic view of an alternative embodiment of the turbine exhaust gas treatment system of FIG. 1 in which thermal oil is used as the working fluid.

Referring now specifically to FIG. 2, a turbine exhaust gas treatment system 200 is shown which is a variant of the turbine exhaust gas treatment system 100 shown in FIG. 1. Instead of using carbon dioxide as a working fluid (e.g., as in the system 100), the system 200 uses thermal oil as the working fluid. The system 200 notably does not include an expansion nozzle and does not include a bypass nozzle. The thermal oil working fluid is not expanded prior to entering the first heat exchanger 208. The system 200 also differs from the system 100 in that the second heat exchanger 210 can be selectively bypassed through control of the system 200.

The system 200 further differs in that the mass inventory management system 218 includes only a single tank 224. The tank 224 is monitored by a level transmitter (LT) and the amount of thermal oil in the cooling loop is controlled to control the system 200 overall as described with reference to FIG. 1.

Figure 3:
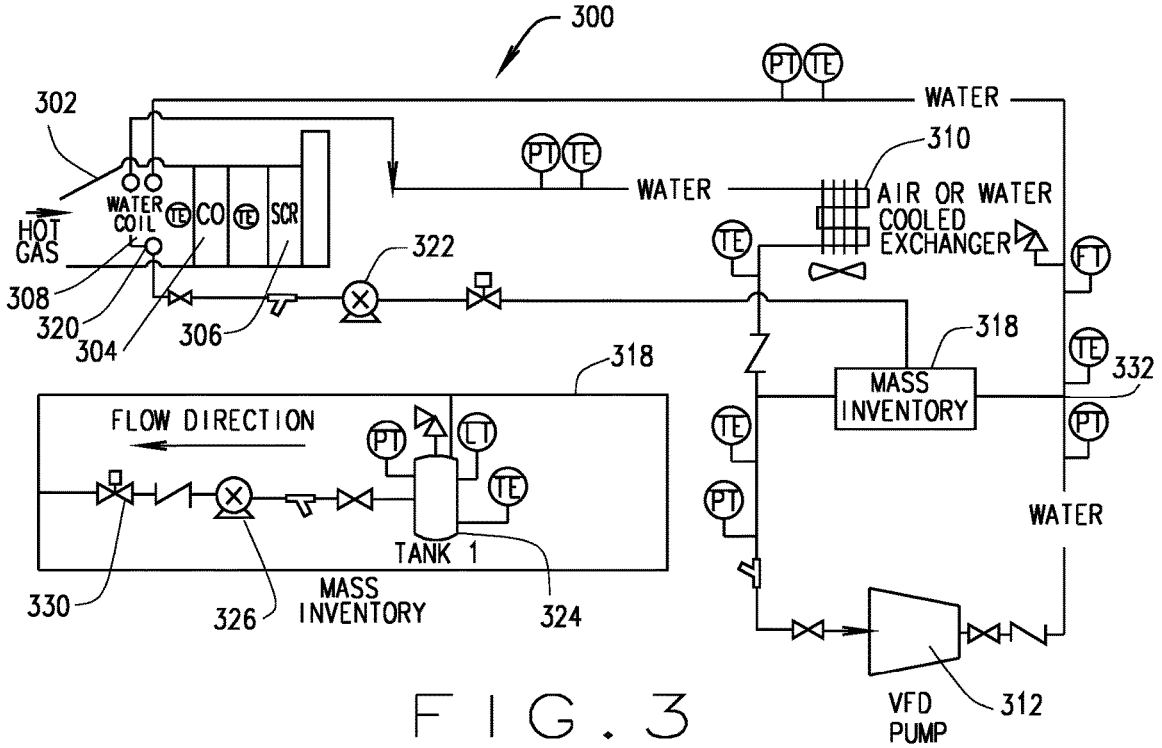
FIG. 3 is a schematic view of an alternative embodiment of the turbine exhaust gas treatment system of FIG. 1 in which water is used as the working fluid.

Referring now to FIG. 3, a turbine exhaust gas treatment system 300 is shown which is a variant of the turbine exhaust gas systems 100, 200 shown in FIGS. 1-2. The turbine exhaust gas treatment system 300 varies from the turbine exhaust gas system 200 shown in FIG. 2 in that water is used as the working fluid. The turbine exhaust gas treatment system 300 further varies in that it does not include a bypass of the second heat exchanger 310.

Figure 4:
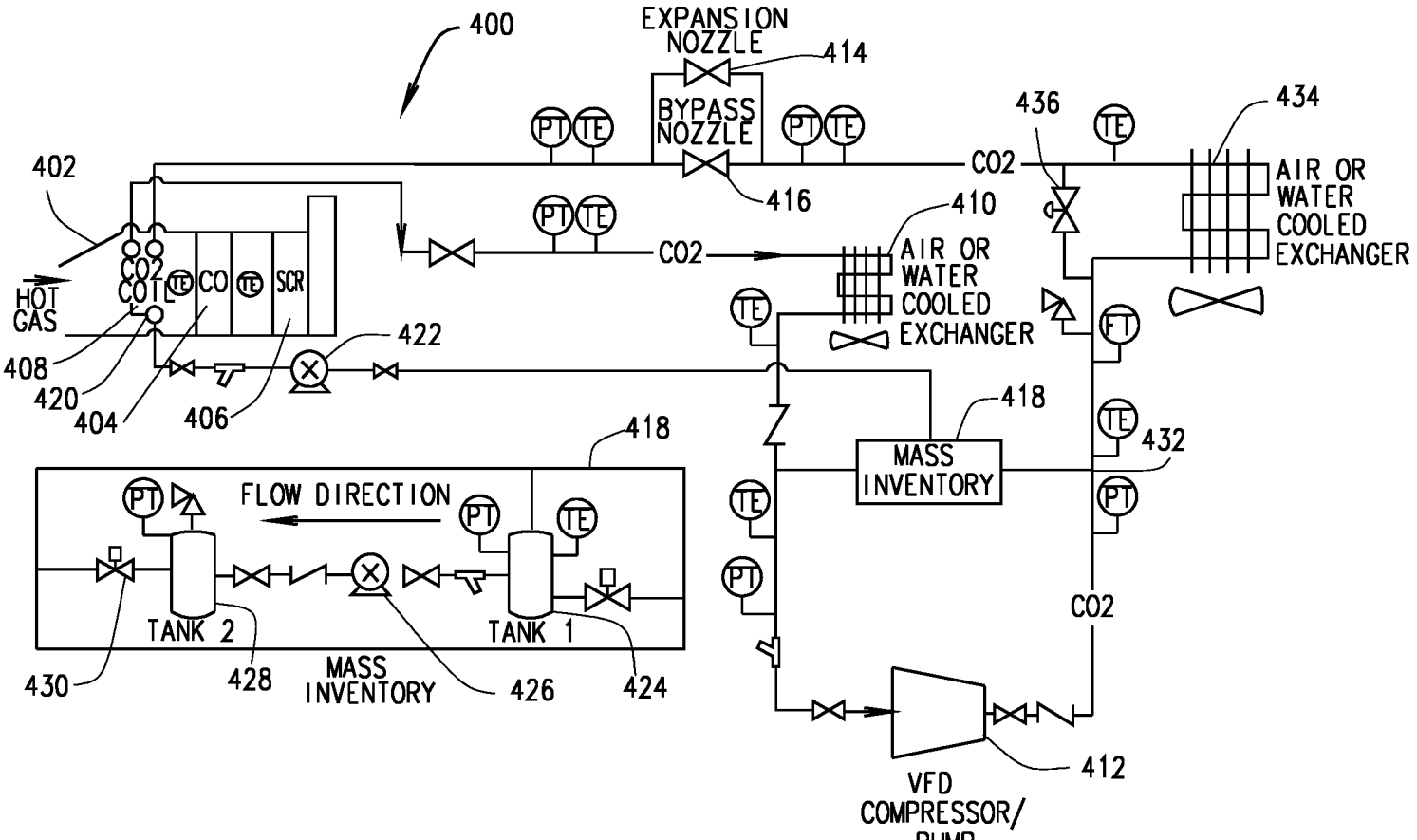
FIG. 4 is a schematic view of an alternative embodiment of the turbine exhaust gas treatment system of FIG. 1 including a heat exchanger positioned between a pump and an expansion nozzle.

Referring now to FIG. 4, a turbine exhaust gas treatment system 400 is shown which is a variant of the turbine exhaust gas system 100 shown in FIG. 1. The turbine exhaust gas treatment system 400 uses carbon dioxide as a working fluid. The turbine exhaust gas treatment system 400 differs from the turbine exhaust gas treatment system 100 in that the turbine exhaust gas treatment system 400 includes a third heat exchanger 434 and additional sensors associated with the third heat exchanger 434 (e.g., a temperature sensor downstream of the third heat exchanger 434 and upstream of the expansion nozzle 414).

The third heat exchanger 434 is positioned downstream of the pump 412 and is adapted and configured to remove heat from the working fluid. The third heat exchanger 434 is either air cooled or water cooled. The third heat exchanger 434 can include a fan to pass ambient air over/through the third heat exchanger 434 such that heat is moved from the working fluid to the ambient atmosphere. As explained with regard to FIG. 1, the fan is controllable to minimize power consumption while maintaining the temperature of the turbine exhaust gas within suitable ranges for treatment with catalyst-based turbine exhaust gas treatment devices, e.g., one or more SCR devices. For example, the fan can be controlled based on the temperature of the working fluid upstream of the third heat exchanger 434, the temperature of the working fluid downstream of the third heat exchanger 434, and/or the temperature of the turbine exhaust gas prior to the first and/or second catalytic exhaust gas treatment device.

The system 400 also includes a bypass valve 436, which can be manual or actuated, adapted and configured to controllably and selectively permit the working fluid to bypass the third heat exchanger 434. The bypass 436 is controlled based on one or more of the inputs described directly above with respect to the control of the fan of the third heat exchanger 434 and/or other factors as generally described for earlier embodiments. The third heat exchanger 434 can be bypassed or partially bypassed to increase the efficiency of the system 434 through decreased power consumption of the associated fan and/or through a lower total pressure drop in the cooling loop. The third heat exchanger 434 is only bypassed when suitable turbine exhaust gas temperature can be maintained without use of the third heat exchanger 434.

Figure 5:
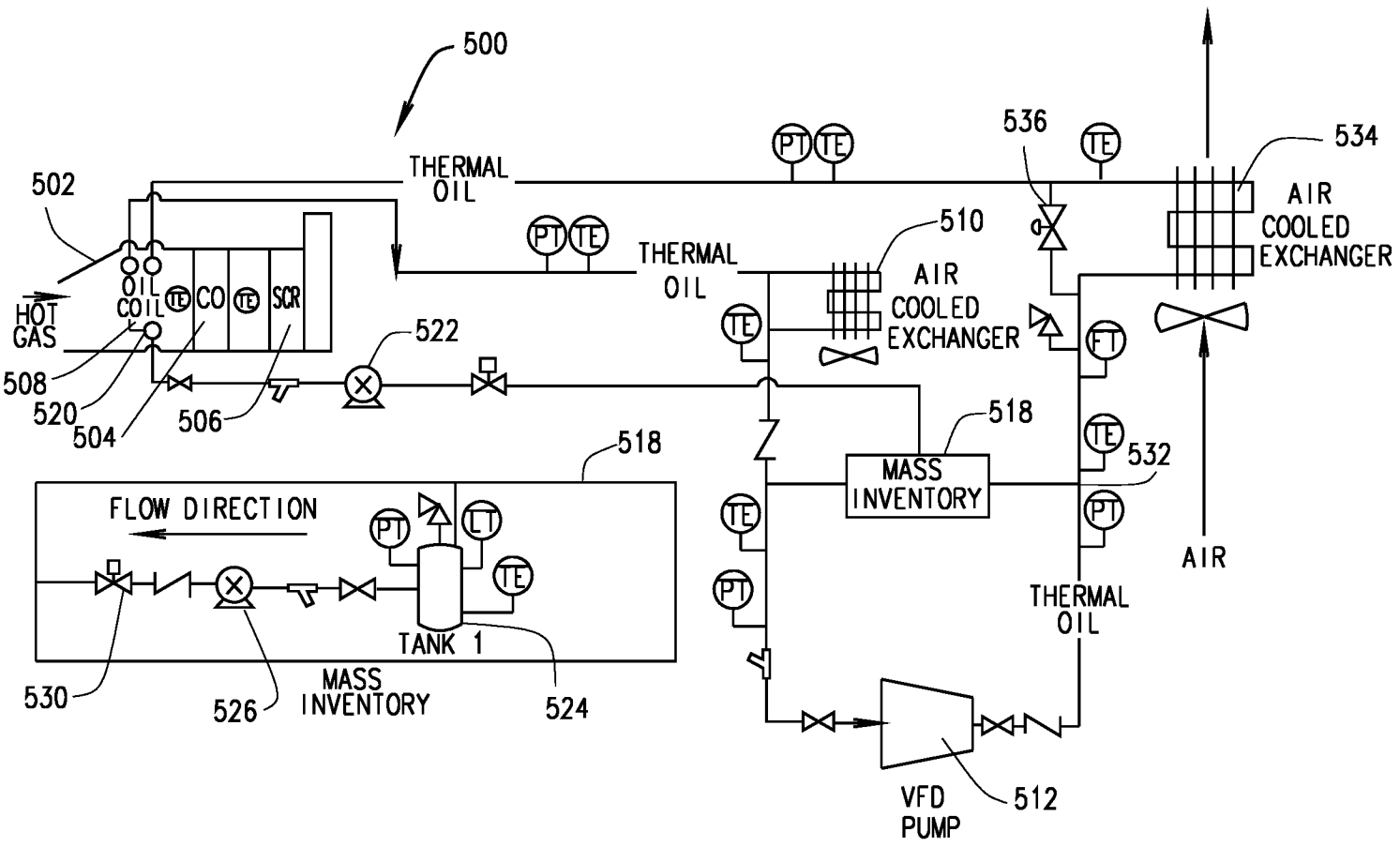
FIG. 5 is a schematic view of an alternative embodiment of the turbine exhaust gas treatment system of FIG. 4 in which thermal oil is used as the working fluid.

Referring now to FIG. 5, a turbine exhaust gas treatment system 500 is shown which is a variant of the turbine exhaust gas system 200 shown in FIG. 2 which includes a third heat exchanger 534 and bypass 536 of the type described with respect to FIG. 4. The turbine exhaust gas treatment system 500 differs from the system 200 in that it includes the third heat exchanger 534. The turbine exhaust gas treatment system 500 differs primarily from the system 400 in that the working fluid is thermal oil. The system 500 has the advantages of the system 200 and the system 400 but uses thermal oil instead of carbon dioxide (as in the system 400).

Figure 6:
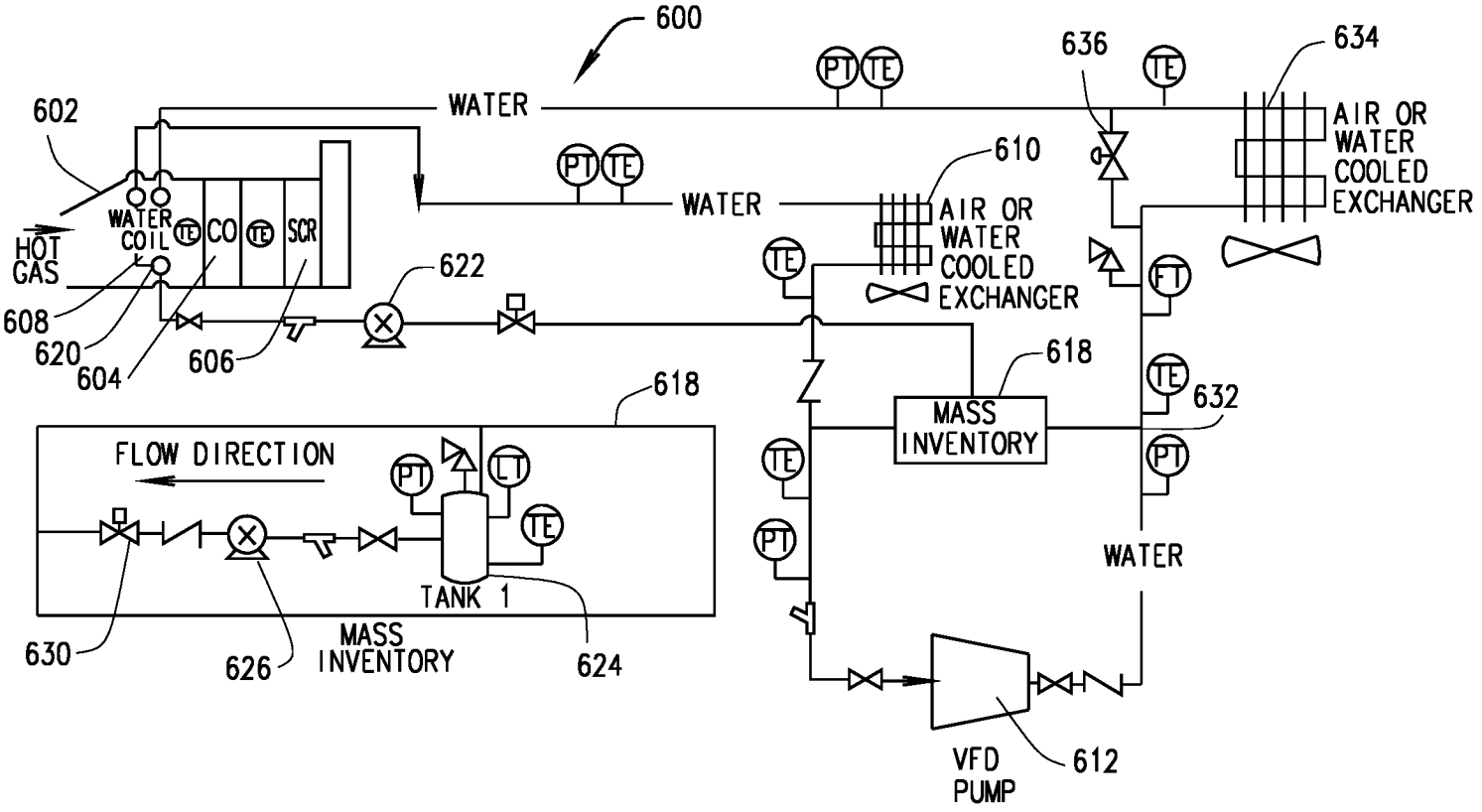
FIG. 6 is a schematic view of an alternative embodiment of the turbine exhaust gas treatment system of FIG. 4 in which water is used as the working fluid.

Referring now to FIG. 6, a turbine exhaust gas treatment system 600 is shown which is a variant of the turbine exhaust gas system 300 shown in FIG. 3 which includes a third heat exchanger 634 and bypass 636 of the type described with respect to FIG. 4. The turbine exhaust gas treatment system 600 differs from the system 300 in that it includes the third heat exchanger 634. The turbine exhaust gas treatment system 600 differs primarily from the system 400 in that the working fluid is water. The system 600 has the advantages of the system 300 and the system 400 but uses water instead of carbon dioxide (as in the system 400).

Figure 7:
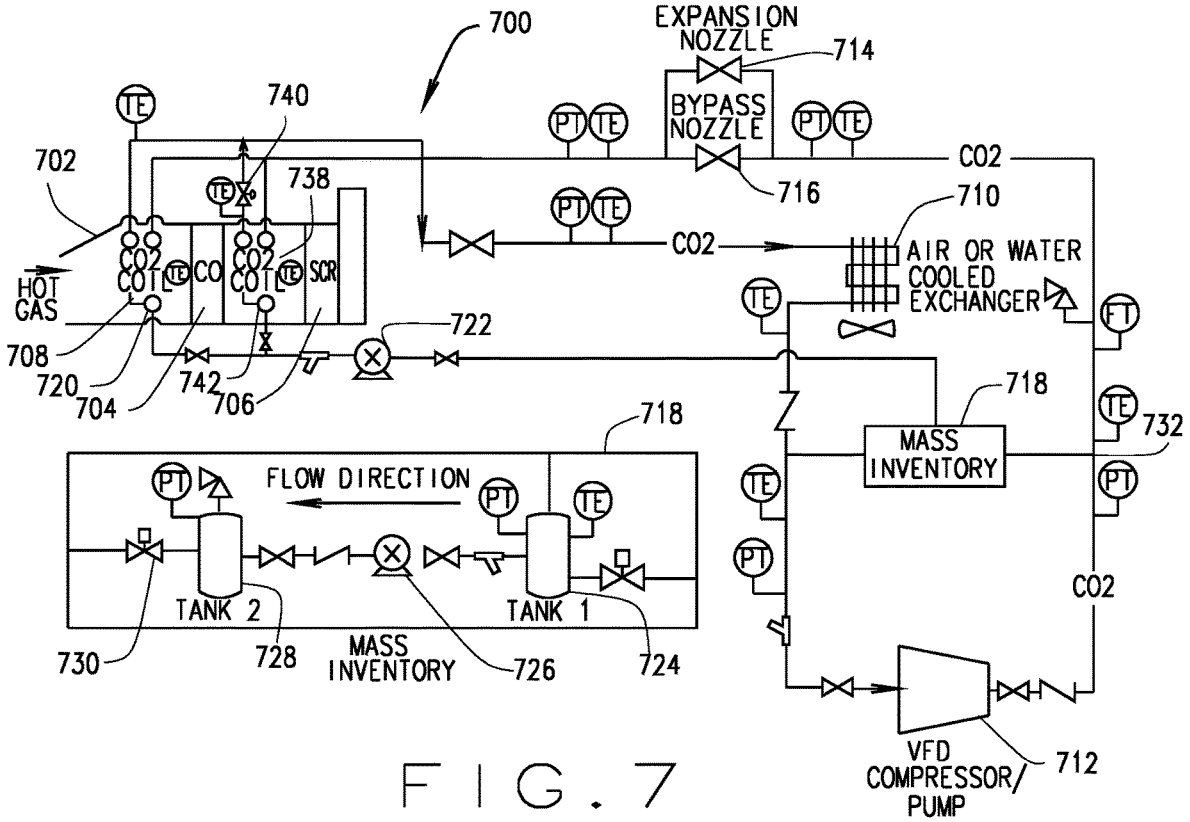
FIG. 7 is a schematic view of an alternative embodiment of the turbine exhaust gas treatment system of FIG. 1 in which split cooling is used to cool turbine exhaust gas prior to a first catalytic treatment device and to further cool the turbine exhaust gas after the first catalytic treatment device and prior to a second catalytic treatment device.

Referring now to FIG. 7, a turbine exhaust gas treatment system 700 is shown which is a variant of the turbine exhaust gas system 100 shown in FIG. 1. The turbine exhaust gas treatment system 700 differs from the system 100 primarily in that the system 700 includes a fourth heat exchanger 738. The fourth heat exchanger 738 is positioned at least partially within the turbine exhaust gas discharge section 702 downstream of the catalytic exhaust gas treatment device 704. The fourth heat exchanger 738 is also upstream of the second catalytic turbine exhaust gas treatment device 706. The fourth heat exchanger 738 is adapted and configured to remove heat from the turbine exhaust gas passing through the turbine exhaust gas discharge structure 102 by transferring heat to the working fluid (e.g., carbon dioxide) passing through and within the fourth heat exchanger 738. The fourth heat exchanger is positioned within the cooling loop downstream of the pump 712 and upstream of the second heat exchanger 710. The fourth heat exchanger 738 is also downstream of the expansion nozzle 714.

The first heat exchanger 708 and the fourth heat exchanger 738 are arranged in parallel loops such that the working fluid is split, with separate portions of the working fluid passing through the first heat exchanger 708 and the fourth heat exchanger 738. The separate portions of the working fluid converge to form a single flow after exiting the first heat exchanger 708 and the fourth heat exchanger 738. The combined output is received by the second heat exchanger 710. The fourth heat exchanger 738 can be adapted and configured to take off from the working fluid prior to the working fluid reaching the first heat exchanger 708 such that the fourth heat exchanger 738 is fed with priority in order to maintain, with priority, a turbine exhaust gas temperature range within operating parameters of the second catalytic exhaust gas treatment device 706. In other words, the flow of the working fluid can branch upstream of the first heat exchanger 708 and the fourth heat exchanger 738 with a portion of the working fluid being fed to the first heat exchanger 708 and a separate portion of the working fluid being fed to the fourth heat exchanger 738. This allows for separate streams of cooled working fluid to separately supply the two heat exchangers (e.g., in a parallel configuration rather than in a serial configuration where a single stream of working fluid is sequentially heated). The length and configuration of the diverging piping can be adapted and configured to feed the fourth heat exchanger 738 with priority. Alternatively, the exchangers (i.e., 708 and 738) can be in series with the same flow of coolant (e.g., CO2) passing through each exchanger with the flow direction of said fluid being either in parallel to the hot turbine exhaust gas stream or counter current with the turbine exhaust gas stream. In other words, one of either of the two heat exchangers can be fed with priority, the heat exchangers can be fed serially, or the heat exchangers can be fed in parallel.

Advantageously, the use of two heat exchangers independently cooling the turbine exhaust gas prior to different catalytic treatment devices allows for independent control of turbine exhaust gas temperature prior to independent treatment devices. This allows for the turbine exhaust gas temperature to be maintained within a first range for treatment by the first catalytic treatment device 704 (e.g., to treat carbon monoxide). The turbine exhaust gas temperature is independently maintained within a second lower temperature range for treatment by the second catalytic treatment device 706 (e.g., an SCR to treat nitrous oxides).

The fourth heat exchanger 738 and the first heat exchanger 708 can be independently controlled based on the working fluid temperature monitored at the outlet of both the first 708 and fourth heat exchanger 738. Flow of the working fluid to the first 708 and fourth heat exchangers 738 can be controlled via a temperature control valve located in the pipeline dedicated to the coil being controlled (e.g., control valve 740). Two temperature control valves can be used (one per heat exchanger) or a single control valve 740 can be used to control the flowrate of working fluid to the fourth heat exchanger 738 with the remainder of the working fluid being provided to the first heat exchanger 708 positioned downstream of the fourth heat exchanger 738.

The system 700 includes a mass inventory management system 718 adapted and configured to controllably receive working fluid downstream of the fourth heat exchanger 738 (e.g., using a controllable valve) at a takeoff point 742. Otherwise, the mass inventory system 718 operates as previously described.

Figure 8:
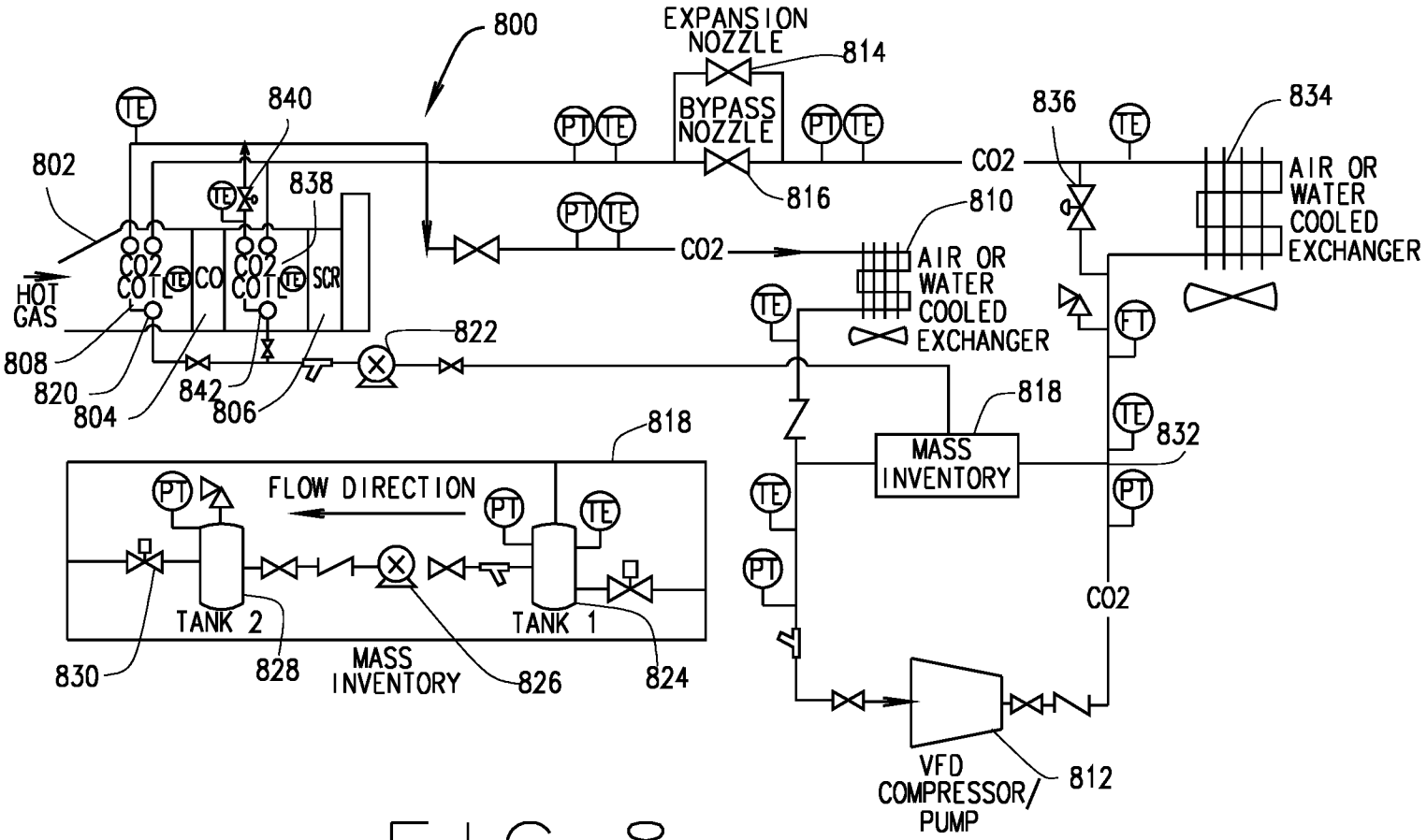
FIG. 8 is a schematic view of an alternative embodiment of the turbine exhaust gas treatment system of FIG. 7 including a heat exchanger positioned between a pump and an expansion nozzle.

Referring now to FIG. 8, a turbine exhaust gas treatment system 800 is shown which is a variant of the turbine exhaust gas system 700 shown in FIG. 7. The turbine exhaust gas treatment system 800 differs from the system 700 primarily in that the system 800 further includes a third heat exchanger 834 and bypass 836 of the type shown and described with respect to FIG. 4. This system 800 combines the benefits of the fourth heat exchanger 838 and third heat exchanger 834 previously described.

Generally, while the use of a fourth heat exchanger is shown only with respect to FIGS. 7-8, it should be understood that a fourth heat exchanger can be used with any of the systems described herein.

Figure 9A:
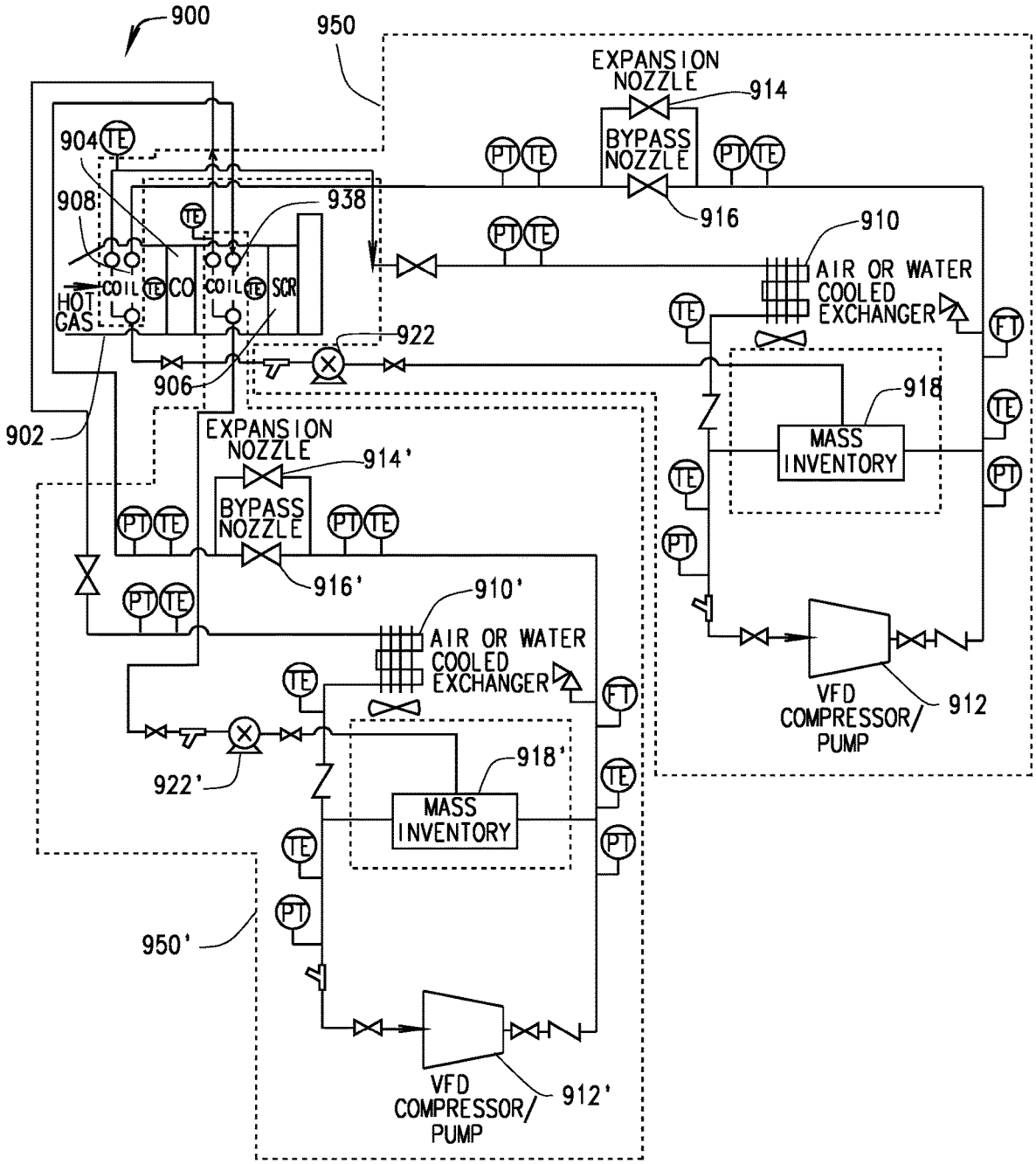
FIG. 9A is a schematic view of an alternative embodiment of the turbine exhaust gas treatment system having independent cooling loops.
Figure 9B:
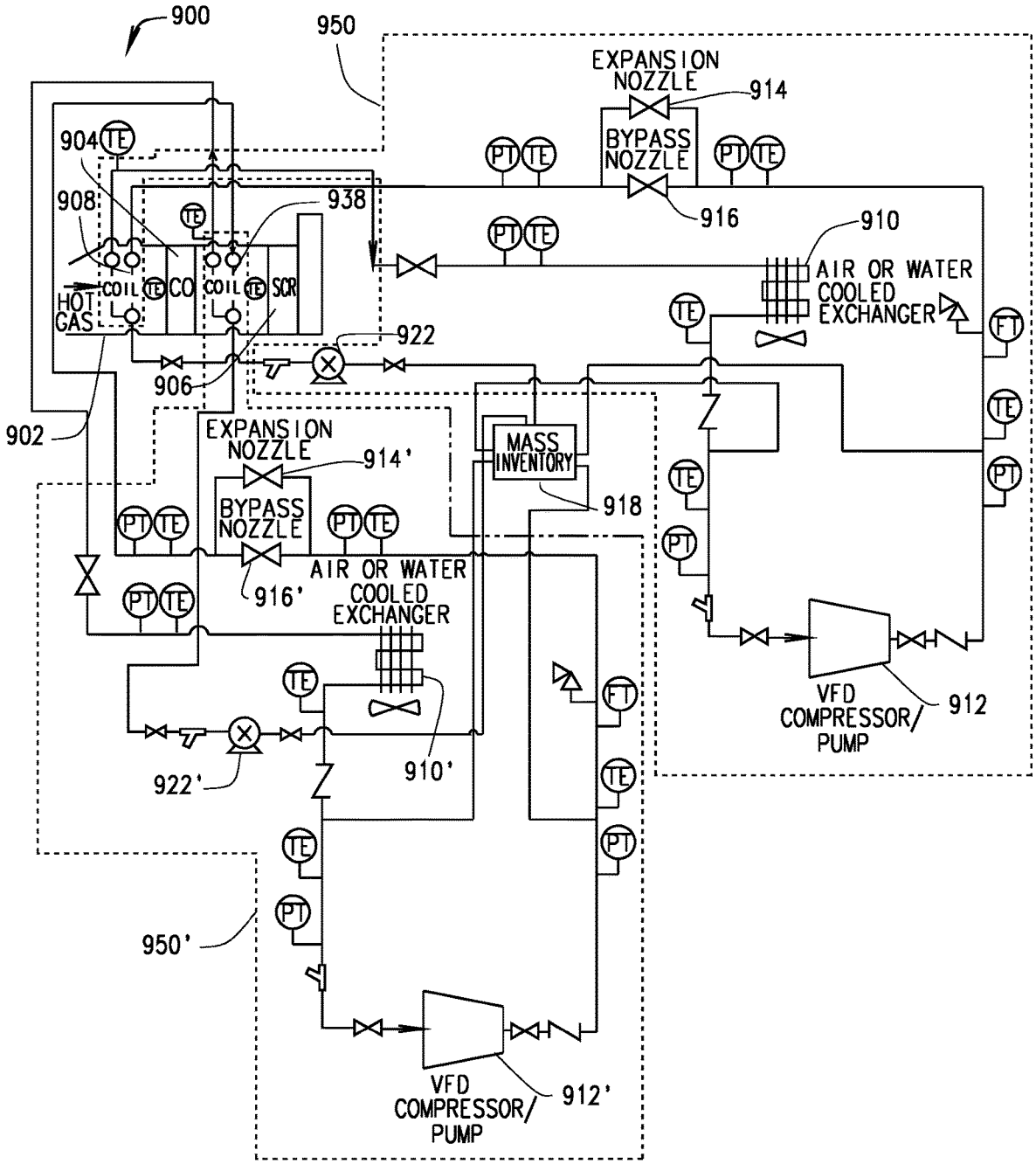
FIG. 9B is a schematic view of an alternative embodiment of the turbine exhaust gas treatment system having independent cooling loops and a common mass inventory system.
Figure 9C:
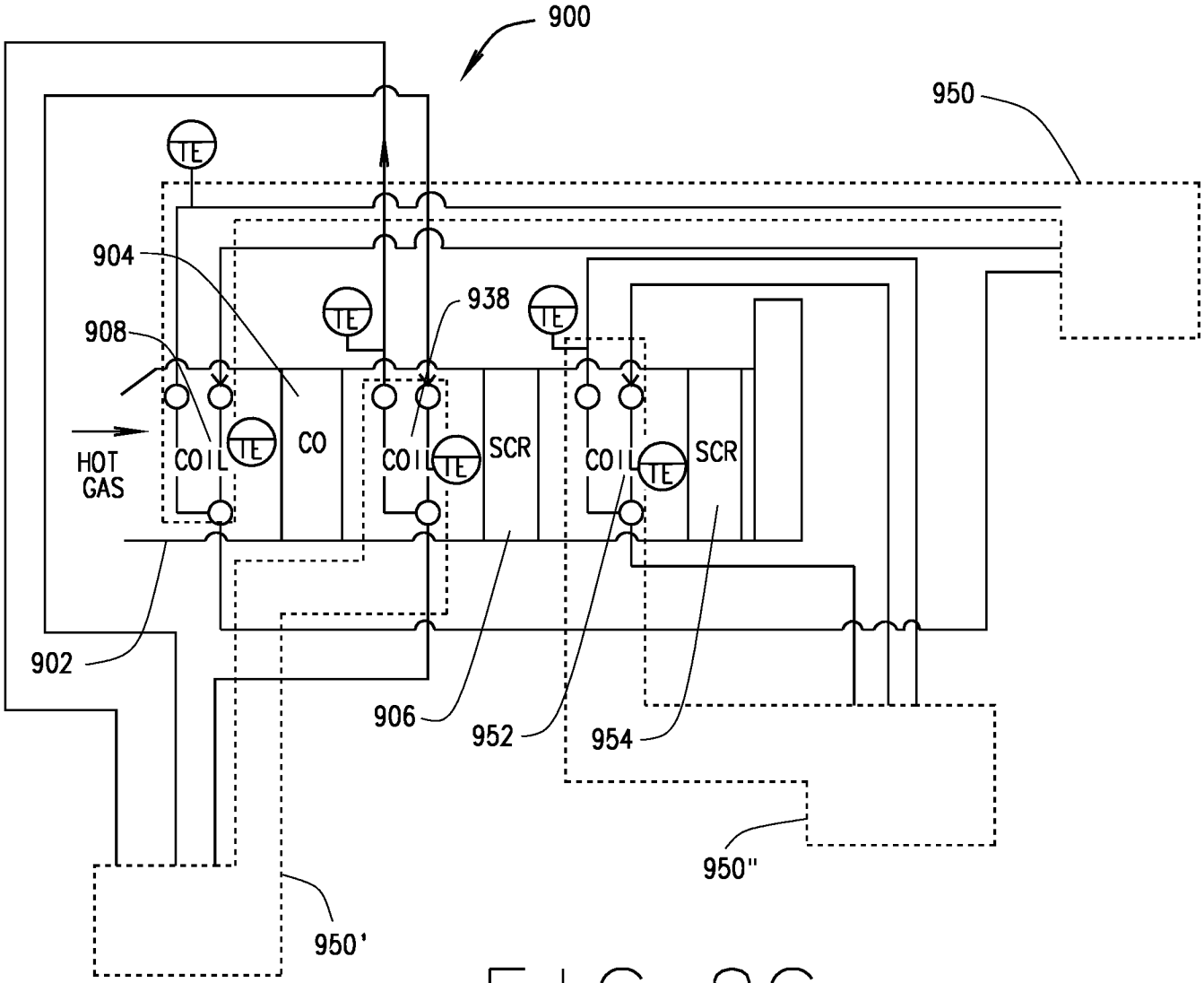
FIG. 9C is a schematic view of an alternative embodiment of the turbine exhaust gas treatment system having three or more independent cooling loops.

Referring generally to FIGS. 9A-9C, multiple independent cooling loops can be used to cool turbine exhaust gas within the turbine exhaust gas discharge structure 902. Each independent cooling loop 950, 950', 950" (shown within dashed lines) cools the turbine exhaust gas within the turbine exhaust gas discharge structure 902 using an independent heat exchanger within the turbine exhaust gas discharge structure 902. The independent cooling loop 950 cools turbine exhaust gas by supplying cooled working fluid to the first heat exchanger 908, receiving heated working fluid from the first heat exchanger 908, and cooling the heated working fluid prior to supplying it to the first heat exchanger 908. The independent cooling loop 950 further includes piping, conduits, valves, or the like illustrated in solid lines to provide for fluid communication and control of the working fluid between the other components of the cooling loop 950. The independent cooling loop 950' cools the turbine exhaust gas discharge structure 902. The independent cooling loop 950' cools turbine exhaust gas by supplying cooled working fluid to the fourth heat exchanger 938, receiving heated working fluid from the fourth heat exchanger 938, and cooling the heated working fluid prior to supplying it to the fourth heat exchanger 938. The independent cooling loop 950' further includes piping, conduits, valves, or the like illustrated in solid lines to provide for fluid communication and control of the working fluid between the other components of the cooling loop 950'.

The independent cooling loop 950 comprises at least a second heat exchanger 910 and a pump 912. Similarly, the independent cooling loop 950' comprises at least a second heat exchanger 910' and a pump 912'. Each independent cooling loop 950, 950' likewise includes a heat exchanger (first and fourth heat exchangers 908, 938) positioned within the turbine exhaust gas discharge structure 902. Each independent cooling loop 950, 950' can include other equipment of the type described herein with respect to any of the embodiments disclosed. For example, each independent cooling loop 950, 950' can include an expansion nozzle 914, 914', a bypass nozzle 916, 916', a mass inventory system 918, 918', a pump 922, 922' adapted to take off and supply the mass inventory system, etc. Each independent cooling loop 950, 950' can also include a third heat exchanger of the type described with respect to FIGS. 4-6 and 8. The mass inventory system 918, 918' can be the type described herein with respect to other embodiments disclosed herein.

It should also be understood that the system 900 including independent cooling loops 950, 950' can utilize any of the working fluids described herein (e.g., carbon dioxide, water, thermal fluid/oil, etc.). The independent cooling loops 950, 950' are independent, with independent mass inventory systems 918, 918', such that the independent cooling loops 950, 950' can use different working fluids. For example, the independent cooling loop 950 can use water as the working fluid, while the independent cooling loop 950' can use carbon dioxide as the working fluid. Any combination of working fluids can be used.

Referring now to FIG. 9B, a system 900 can include independent cooling loops 950, 950' but with a shared mass inventory system 918. This embodiment is substantially similar to that described with respect to FIG. 9A with the substantial difference being that the independent cooling loops 950, 950' share a single mass inventory system 918 and the independent cooling loops are capable of sharing a working fluid. The mass inventory system 918 can be any of the configurations described herein with reference to other embodiments and figures with suitable modifications to provide for double the inputs and outputs to account for two separate cooling loops 950, 950'. The mass inventory system 918 is adapted and configured to allow for the transfer of working fluid between the separate cooling loops 950, 950'.

Referring now to FIG. 9C, the system 900 of the types described herein can include any number of catalytic turbine exhaust gas treatment devices and any number of separate cooling loops 950, 950', and 950". For example, and as depicted in FIG. 9C, the system 900 includes three catalytic turbine exhaust gas treatment devices. A first heat exchanger 908 adapted and configured to cool turbine exhaust within the turbine exhaust gas discharge structure upstream of the first catalytic turbine exhaust gas treatment device 904 in conjunction with the separate cooling loop 950. A fourth heat exchanger 938 cools turbine exhaust gas upstream of a second catalytic turbine exhaust gas treatment device 906 in conjunction with the separate cooling loop 950'. A sixth heat exchanger 952 cools turbine exhaust gas upstream of a third catalytic turbine exhaust gas treatment device 954 in conjunction with the separate cooling loop 950". In this embodiment, each separate cooling loop 950, 950', 950" includes a distinct mass inventory system and each loop is capable of using a different working fluid. It should be understood that three or more separate cooling loops can be utilized with a single mass inventory system of the type described with reference to FIG. 9B. It should also be understood that three or more catalytic turbine exhaust gas treatment devices can be used in a system with a single cooling loop with parallel branches feeding each separate heat exchanger (e.g., as shown in at least FIG. 7).

Referring generally to FIGS. 1-9C, the systems described herein includes a plurality of heat exchangers described generally. It should be understood that the heat exchangers described herein can be of any suitable configuration. For example, any or all of the heat exchangers can be parallel flow heat exchangers, cross flow heat exchangers, counter flow heat exchangers, or any other suitable heat exchanger.

It should also be understood that the systems described herein include a plurality of catalytic turbine exhaust gas treatment devices. But in alternative embodiments, one or more of the catalytic turbine exhaust gas treatment devices can be substituted with other turbine exhaust gas treatment devices including but not limited to non-catalyst treatment system(s). Non-catalyst treatment systems can comprise a membrane adapted and configured to remove one or more compounds from the turbine exhaust, a urea injection system, or other system. For example, the membrane can be a synthetic membrane made from polymers, cellulose acetate, or ceramic materials. Any suitable material can be used for the membrane, the membrane being adapted and configured to remove carbon monoxide, nitrous oxides, sulfur dioxide, hexane, carbon dioxide, butane, methane, benzene, or other compounds.

Still referring generally to FIGS. 1-9C, the systems described herein provide the benefits described herein of improved turbine exhaust gas treatment. The systems provide increased control over the temperature of turbine exhaust gases such that the turbine exhaust gases can be treated. The systems described further provide for increased efficiency through the control of various components of the cooling subsystem used in cooling the turbine exhaust gas for treatment. Further, the systems described herein utilize a working fluid cooling system and corresponding techniques (e.g., such as refrigeration or other general cooling methods) such that the systems do not use or include a forced draft fan to mix air with the turbine exhaust gas nor does the system need to inject water into the hot turbine exhaust gas stream. This increases efficiency by eliminating the power consumption associated with a forced draft fan as well as reducing the negative effects which can occur as a result of water injection (e.g., corrosion). Similarly, the systems described do not use or include an induced draft fan. These fans are unnecessary as additional upstream air is not required to cool the turbine exhaust gas due to the use of the cooling system described herein. The systems described herein further allow for the turbine exhaust gas, once treated, to be exhausted directly to the atmosphere.

Figure 10:
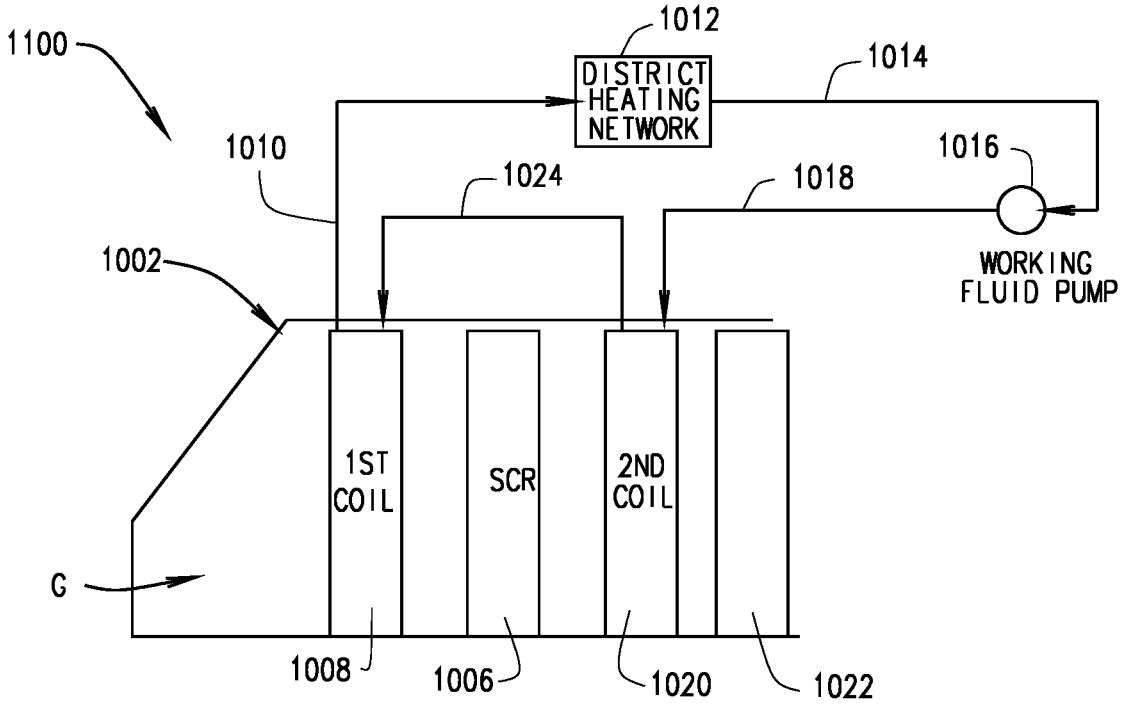
FIG. 10 is a schematic view of an alternative embodiment of a turbine exhaust gas treatment system including district heating positioned downstream of the first heat exchanger and a second heat exchanger positioned downstream from the district heating.

FIG. 10 is a representation of a further embodiment of the system 1000 for treating turbine exhaust gas of this disclosure. As in the embodiment of FIG. 1, the system 1000 of FIG. 10 also includes an exhaust gas discharge structure 1002 communicating with a gas turbine operating in a simple cycle. The exhaust gas discharge structure 1002 is structured and constructed at a position adjacent to a gas turbine emitting exhaust gas G and thereby is adapted and configured to receive exhaust gas G emitted from the gas turbine operating in a simple cycle (i.e., there is no heat recovery steam generator HRSG operating with the gas turbine). The exhaust gas discharge structure 1002 is adapted and configured to receive hot exhaust gas G from the gas turbine and direct the exhaust gas to pass through the exhaust gas discharge structure 1002. As in the previously described systems, the exhaust gas discharge structure 1002 represented in FIG. 10 also comprises a catalytic converter or a catalytic turbine exhaust gas treatment device such as a Selective Catalytic Reduction (SCR) device 1006 inside the exhaust gas discharge structure 1002.

As in the embodiment of FIG. 1, the exhaust gas G passing through the exhaust gas discharge structure 1002 of FIG. 10 passes through the SCR 1006. The SCR 1006 is adapted and configured to receive the exhaust gas and treat at least one component of the turbine exhaust gas G through a catalytic reaction between a catalyst contained in the SCR 1006 and the at least one component of the turbine exhaust gas G. In order to reduce the temperature of the turbine exhaust gas G to within a range suitable for treatment with the SCR 1006, the system 1000 of FIG. 10 further comprises a heat transfer coil of a first heat exchanger 1008 positioned at least partially within the exhaust gas discharge structure 1002 and upstream of the SCR 1006. In the same manner as the embodiment of FIG. 1, the first heat exchanger 1008 is adapted and configured to receive the flow of exhaust gas passing through the exhaust gas discharge structure 1002 and remove heat from and cool the flow of exhaust gas G passing through the exhaust gas discharge structure 1002 by transferring heat to a working fluid passing through and within the heat transfer coil of the first heat exchanger 1008. The working fluid can be carbon dioxide, water, thermal oil or any other fluid employed in heat exchangers. The first heat exchanger 1008 is part of a cooling loop and the working fluid passes through the cooling loop to continuously provide cooling to the exhaust gas G during operation of the system 1000. As in the earlier described embodiments, the exhaust gas can be cooled for a purpose other than improving the treatment of the exhaust gas by the SCR 1006. For example, the exhaust gas can be cooled to maintain the exhaust gas within a specified temperature range irrespective of a temperature range for treating the exhaust gas by the SCR 1006.

Working fluid passes through the first heat exchanger 1008 and is heated by the turbine exhaust gas G passing through the first heat exchanger. The heated working fluid then leaves the first heat exchanger 1008 with additional heat and is directed through a first conduit 1010 or other fluid conveying device. The first conduit 1010 extends from the first heat exchanger 1008 to one or more heat exchangers of a district heating (DH) system 1012. The district heating system 1012 comprises a distribution network communicating the flow of working fluid in the cooling loop with heat exchangers of the district heating system and communicating the flow of working fluid from the heat exchangers of the district heating system with the cooling loop. The district heating system 1012 is outside the exhaust gas discharge structure 1002.

The district heating system 1012 or heat network or teleheating system is adapted and configured to distribute heat generated in the centralized location of the gas turbine through a distribution network, for example a network of insulated pipes. The distribution network is adapted and configured to communicate the generated heat to users of the heat, for example residential and/or commercial users to satisfy their heating requirements. The working fluid leaving the first heat exchanger 1008 enters the heat exchanger(s) of the district heating system 1012 positioned downstream of the first heat exchanger 1008. The district heating system 1012 is adapted and configured to remove heat from the working fluid gained at the first heat exchanger 1008.

The working fluid then leaves the district heating system 1012 having been cooled by the district heating and is directed through a second conduit 1014 to a pump 1016. The pump 1016 is positioned downstream from the district heating 1012 and is adapted and configured to receive the cooled working fluid from the second conduit 1014 and drive the working fluid through the cooling loop. The pump 1016 can be driven by an electric motor or other type of drive mechanism.

The pump 1016 drives the working fluid through a third conduit 1018 of the cooling loop. The third conduit 1018 extends from the pump 1016 to the heat transfer coils of a second heat exchanger 1020 and is adapted and configured to direct the working fluid from the pump 1016 to a heat transfer coil of the second heat exchanger 1020. The second heat exchanger 1020 is positioned in the gas turbine exhaust flow path that has passed through the SCR 1006 and is exiting the SCR. Working fluid passing through the second heat exchanger 1020 again gains heat from and cools the flow of gas turbine exhaust exiting the SCR 1006. The second heat exchanger 1020 is adapted and configured to further cool the gas turbine exhaust gas exiting the SCR 1006 and passing through the second heat exchanger 1020 prior to the exhaust gas entering into a further downstream component of the exhaust gas discharge structure 1002. For example, the further downstream component of the exhaust gas discharge structure 1002 could be a second, additional catalytic converter such as a second SCR 1022.

A fourth conduit 1024 extends from the second heat exchanger 1020 to the first heat exchanger 1008 and is adapted and configured to direct the working fluid from the second heat exchanger 1020 to the first heat exchanger 1008. The second heat exchanger 1020 is positioned downstream of the pump 1016 and upstream of the first heat exchanger 1008 and recovers some final residual heat from the turbine exhaust gas exiting the SCR 1006 before then directing the working fluid through the cooling loop back to the first heat exchanger 1008.

As represented in FIG. 10, the first heat exchanger 1008, the catalytic converter or SCR 1006 and the second heat exchanger 1020 are inside the exhaust gas discharge structure 1002. The exhaust gas discharge structure 1002 is adapted and configured to direct exhaust gas received from the gas turbine operating in the simple cycle through the first heat exchanger 1008, then through the catalytic converter or SCR 1006 and then through the second heat exchanger 1020. The district heating system 1012 is outside the exhaust gas discharge structure 1002 and is remote from the structure. The pump 1016, although in the cooling loop is also outside the exhaust gas discharge structure 1002, although the pump could be located inside the structure.

Figure 11:
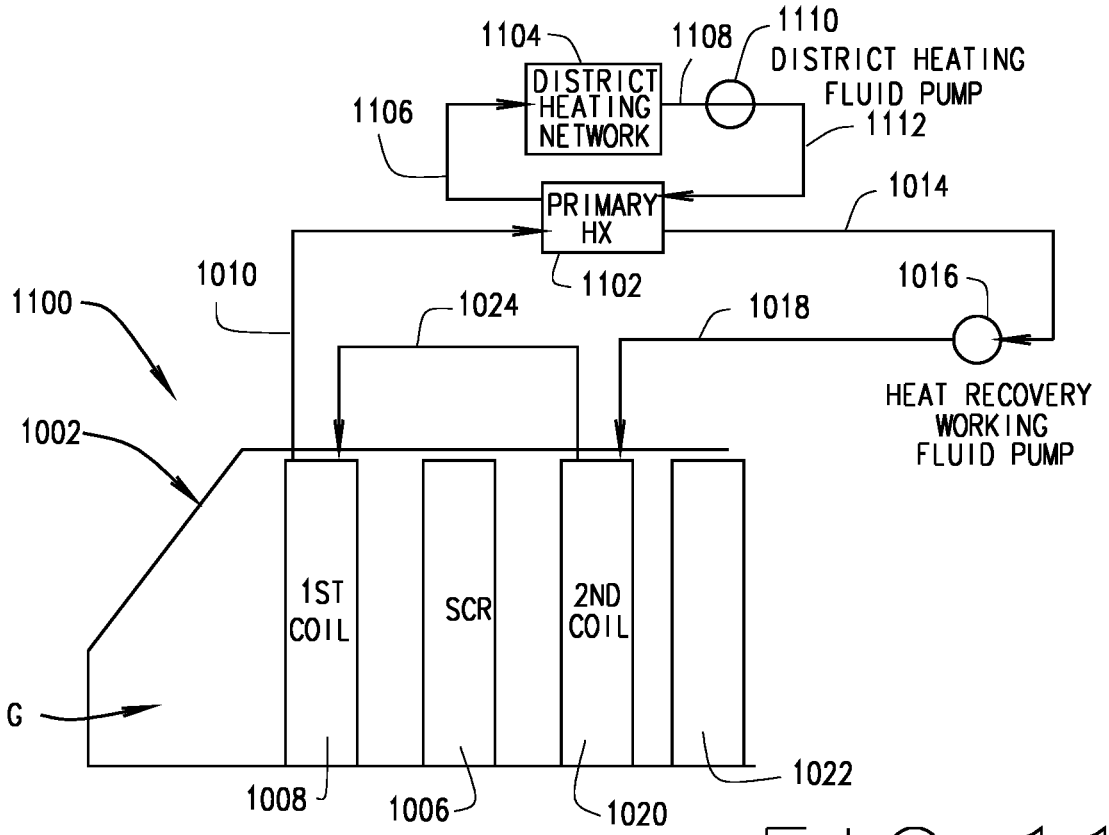
FIG. 11 is a representation of the system of FIG. 10, with a primary heat exchanger added to the district heating loop with the district heating network.

FIG. 11 is a representation of a still further embodiment of a system 1100 for treating turbine exhaust gas of this disclosure. The embodiment of FIG. 11 is substantially the same as the embodiment of FIG. 10 discussed above. Component parts of the system 1100 of FIG. 11 that are the same as the component parts of the system 1000 of FIG. 10 are labeled with the same reference numbers employed in FIG. 10. As in the system 1000 of FIG. 10, the system 1100 of FIG. 11 also includes the exhaust gas discharge structure 1002 that is adapted and configured to receive exhaust gas G emitted from a gas turbine and direct the exhaust gas to pass through the exhaust gas discharge structure 1002. As in the previously described systems, the exhaust gas discharge structure 1002 of FIG. 11 also comprises a catalytic converter or catalytic turbine exhaust gas treatment device such as a Selective Catalytic Reduction (SCR) device 1006 inside the exhaust gas discharge structure 1002. The SCR 1006 functions in the same manner as previously described.

As in the system 1000 of FIG. 10, the system 1100 of FIG. 11 also comprises a heat transfer coil of a first heat exchanger 1008 positioned at least partially within the exhaust gas discharge structure 1002 upstream of the SCR 1006. The first heat exchanger 1008 functions in the same manner as previously described.

As in the system 1000 of FIG. 10, in the system 1100 of FIG. 11 the first heat exchanger 1008 is part of a cooling loop. Working fluid that passes through the first heat exchanger 1008 is heated at the first heat exchanger 1008 and is then directed through a first conduit 1010 extending from the first heat exchanger 1008. However, instead of extending to the district heating system 1012 as in the system 1000 of FIG. 10, the first conduit 1010 of the system 1100 of FIG. 11 extends from the first heat exchanger 1008 to heat exchanger coils of a primary heat exchanger 1102. Heat gained by the working fluid at the first heat exchanger 1008 is transferred to the heat exchanger coils of the primary heat exchanger 1102. The primary heat exchanger 1102 is part of a district heating loop that includes a district heating system 1104. The primary heat exchanger transfers heat to the district heating loop as will be described.

The working fluid that has been cooled by the primary heat exchanger 1102 transferring heat to the district heating loop is directed through the second conduit 1014 to the pump 1016. The pump 1016 receives the cooled working fluid from the primary heat exchanger 1102 and drives the working fluid through the third conduit 1018 of the cooling loop.

The third conduit 1018 extends from the pump 1016 to the heat transfer coils of the second heat exchanger 1020. As described earlier, the second heat exchanger 1020 is positioned in the path of gas turbine exhaust flow that has passed through and is exiting the SCR 1006. The working fluid passing through the second heat exchanger 1020 again gains heat from and cools the flow of gas turbine exhaust exiting the SCR 1006. The exhaust gas then passes through the further downstream component of the exhaust gas discharge structure 1002, for example the second SCR 1022.

In the same manner as previously described, the fourth conduit 1024 extends from the second heat exchanger 1020 to the first heat exchanger 1008 and directs the working fluid from the second heat exchanger back to the first heat exchanger.

The system 1100 of FIG. 11 differs from the system 1000 of FIG. 10 in that a fifth conduit 1106 extends from the primary heat exchanger 1102 to the district heating system 1104. The fifth conduit 1106 directs working fluid that has gained heat from heat transfer coils of the primary heat exchanger 1102 to the district heating system 1104. The district heating system 1104 of FIG. 11 is substantially the same type of district heating system 1012 of FIG. 10 described earlier. The working fluid leaving the primary heat exchanger 1102 enters the heat exchangers of the district heating system 1104 positioned downstream of the primary heat exchanger 1102. The district heating system 1104 is adapted and configured to remove heat from the working fluid gained at the primary heat exchanger 1102 and distribute the heat through a distribution network in the same manner as previously described.

In FIG. 11 the working fluid leaves the district heating system 1104, having been cooled by the district heating, and is directed through a sixth conduit 1108 to a pump 1110. The pump 1110 is positioned downstream from the district heating system 1104 and is adapted and configured to receive the cooled working fluid from the sixth conduit 1108 and drive the working fluid through the district heating loop. The pump 1110 drives the working fluid through a seventh conduit 1112 of the district heating loop back to the primary heat exchanger 1102, completing the district heating loop.

Further advantages of the systems described herein include the following. The systems described herein can eliminate the need for, or reduce the complexity of, flow conditioning devices in the turbine exhaust gas stream, which are often required to ensure good hot turbine exhaust gas flow distribution at the face of the catalyst systems. These flow distribution devices are subject to high turbine exhaust gas temperature and very turbulent turbine exhaust gas flows resulting in a high cost to supply/install due to the requirements of operation. The systems described herein can eliminate or reduce these flow distribution devices as a result of the turbine exhaust gas being more controllably cooled and/or as a result of the elimination of any dilution air. In other words, flow distribution devices are not needed to adequately mix dilution air with the turbine exhaust gas as the described systems do not use dilution air. Further or alternatively, the heat exchangers positioned within the turbine exhaust gas discharge structure can adequately distribute flow of the turbine exhaust gas.

It should also be understood that while the systems described transfer heat from the turbine exhaust gas, to be used for heating applications, the energy may also be used for power generation. The heated working fluid can heat other process fluids through a heat exchanger. The heated working fluid can drive a mechanical device (e.g., a pump). Further, the heated working fluid can be expanded to drive a turbine which in turn drives an electrical generator.

Further, while the invention is not limited to the use of CO2, CO2 specifically, results in lower pumping power required compared to other gases/vapors and provides an inert fluid such that the systems described do not need to consider potential hazardous operation that might be required with other fluids The use of CO2 also eliminates the need for the facility to have to remove the fluid from the system during periods when not in operation while freezing conditions exist or from having to provide costly (capital and operating) heat trace equipment to prevent freezing (e.g. systems using water for medium) or sludging (oil systems). A stack damper typically required to reduce air flow through the gas path during freezing conditions is also not used by the described systems.

As various changes could be made in the above constructions and methods without departing from the broad scope of the disclosure, it is intended that all matter contained in the above description or shown in the accompanying drawings shall be interpreted as illustrative and not in a limiting sense.

The invention claimed is:

1. A system for treating gas turbine exhaust gas comprising:

a first heat exchanger, the first heat exchanger is adapted and configured to receive exhaust gas and cool the exhaust gas as the exhaust gas passes through the first heat exchanger;

a catalytic converter, the catalytic converter is adapted and configured to receive exhaust gas from the first heat exchanger, the catalytic converter is adapted and configured to reduce certain gas emissions from the exhaust gas received from the first heat exchanger as the exhaust gas from the first heat exchanger passes through the catalytic converter;

a second heat exchanger, the second heat exchanger is adapted and configured to receive exhaust gas from which certain emissions have been reduced from the catalytic converter, the second heat exchanger is adapted and configured to cool the exhaust gas received from the catalytic converter as the exhaust gas passes through the second heat exchanger;

a cooling loop, the cooling loop is adapted and configured to receive a flow of working fluid from the first heat exchanger and direct the flow of working fluid from the first heat exchanger to the second heat exchanger, and the cooling loop is adapted and configured to receive a flow of working fluid from the second heat exchanger and direct the flow of working fluid from the second heat exchanger to the first heat exchanger;

a district heating system, the district heating system is connected in the cooling loop and in fluid communication with the flow of working fluid directed through the cooling loop;

an exhaust gas discharge structure;

the first heat exchanger is at least partially within the exhaust gas discharge structure, and the catalytic converter and the second heat exchanger are inside the exhaust gas discharge structure; and the district heating system is outside the exhaust gas discharge structure.

2. The system of claim 1, further comprising:

the district heating system comprising a distribution network, the distribution network is adapted and configured to communicate the flow of working fluid in the cooling loop with heat exchangers of the district heating system and to communicate the flow of working fluid from the heat exchangers of the district heating system with the cooling loop.

3. The system of claim 1, further comprising:

the catalytic converter is a first catalytic converter; and a second catalytic converter, the second catalytic converter is adapted and configured to receive exhaust gas that has been cooled from the second heat exchanger, the second catalytic converter is adapted and configured to reduce certain gas emissions from the exhaust gas received from the second heat exchanger as the exhaust gas received from the second heat exchanger passed through the second catalytic converter.

4. The system of claim 1, further comprising:

a pump, the pump is connected in the cooling loop in fluid communication with the flow of working fluid directed through the cooling loop.

5. The system of claim 3, further comprising:

the second catalytic converter is inside the exhaust gas discharge structure.

6. The system of claim 3, further comprising:

the exhaust gas discharge structure is adapted and configured to communicate with a gas turbine and receive exhaust gas from the gas turbine, the exhaust gas discharge structure is adapted and configured to direct the exhaust gas received from the gas turbine through the first heat exchanger, through the catalytic converter, through the second heat exchanger and through the second catalytic converter.

7. The system of claim 6, further comprising:

the exhaust gas discharge structure is adapted and configured to communicate with the gas turbine where the gas turbine is operating in a simple cycle.

8. The system of claim 3, further comprising:

the exhaust gas discharge structure is adapted and configured to communicate with a gas turbine operating in a simple cycle and to receive exhaust gas from the gas turbine operating in the simple cycle, the exhaust gas discharge structure is adapted and configured to direct the exhaust gas received from the gas turbine operating in the simple cycle through the first heat exchanger, through the catalytic converter, through the second heat exchanger and through the second catalytic converter.

9. The system of claim 1, further comprising:

a first conduit, the first conduit is adapted and configured to communicate the working fluid from the first heat exchanger to the district heating system;

a second conduit, the second conduit is adapted and configured to communicate the working fluid from the district heating system to a pump;

a third conduit, the third conduit is adapted and configured to communicate the working fluid from the pump to the second heat exchanger; and a fourth conduit, the fourth conduit is adapted and configured to communicate the working fluid from the second heat exchanger to the first heat exchanger.

10. A system for treating exhaust gas of a gas turbine comprising:

a first heat exchanger, the first heat exchanger is adapted and configured to receive a flow of exhaust gas of a gas turbine and cool the flow of exhaust gas as the flow of exhaust gas passes through the first heat exchanger;

a catalytic converter, the catalytic converter is adapted and configured to receive the flow of exhaust gas of the gas turbine from the first heat exchanger and reduce certain gas emissions from the flow of exhaust gas as the flow of exhaust gas passes through the catalytic converter;

a second heat exchanger, the second heat exchanger is adapted and configured to receive the flow of exhaust gas of the gas turbine from which certain emissions have been reduced from the catalytic converter and cool the flow of exhaust gas as the flow of exhaust gas passes through the second heat exchanger;

a district heating system, the district heating system being outside of the flow of exhaust gas of the gas turbine;

a cooling loop, the cooling loop is adapted and configured to receive a flow of working fluid from the first heat exchanger and direct the flow of working fluid from the first heat exchanger to the district heating system, and the cooling loop is adapted and configured to receive the flow of working fluid from the district heating system and direct the flow of working fluid from the district heating system to the second heat exchanger, and the cooling loop is adapted and configured to receive the flow of working fluid from the second heat exchanger and direct the flow of working fluid from the second heat exchanger to the first heat exchange;

an exhaust discharge structure, the exhaust discharge structure is adapted and configured to receive the flow of exhaust gas of the gas turbine and to direct the flow of exhaust gas to the first heat exchanger, and then to direct the flow of exhaust gas from the first heat exchanger to the catalytic converter, and then to direct the flow of exhaust gas from the catalytic converter to the second heat exchanger; and the district heating system being outside the exhaust gas discharge structure.

11. The system of claim 10, further comprising:

the district heating system comprising a distribution network, the distribution network is adapted and configured to direct the flow of working fluid in the cooling loop to heat exchangers of the district heating system and to direct the flow of working fluid from the heat exchangers of the district heating system to the cooling loop.

12. The system of claim 10, further comprising:

the catalytic converter is a first catalytic converter; and a second catalytic converter, the second catalytic converter is adapted and configured to receive exhaust gas that has been cooled from the second heat exchanger, the second catalytic converter is adapted and configured to reduce certain gas emissions from the exhaust gas received from the second heat exchanger as the exhaust gas received from the second heat exchanger passes through the second catalytic converter.

13. The system of claim 10, further comprising:

a pump, the pump is adapted and configured to receive the flow of working fluid from the cooling loop and direct the flow of working fluid through the cooling loop.

14. The system of claim 10, further comprising:

the cooling loop including a pump, the pump is adapted and configured to receive the flow of working fluid from the district heating system and to direct the flow of working fluid through the cooling loop to the second heat exchanger.

15. The system of claim 10, further comprising:

an exhaust discharge structure, the exhaust discharge structure is adapted and configured to receive the flow of exhaust gas of the gas turbine and direct the flow of exhaust gas to the first heat exchanger, and then to direct the flow of exhaust gas from the first heat exchanger to the catalytic converter, and then to direct the flow of exhaust gas from the catalytic converter to the second heat exchanger; and the district heating system being outside the exhaust gas discharge structure.

16. The system of claim 10, further comprising:

an exhaust gas discharge structure; the first heat exchanger, the catalytic converter and the second heat exchanger being inside the exhaust gas discharge structure; the district heating system being outside the exhaust gas discharge structure; and the exhaust gas discharge structure is adapted and configured to communicate with a gas turbine and receive exhaust gas of the gas turbine, the exhaust gas discharge structure is adapted and configured to direct the exhaust gas of the gas turbine through the first heat exchanger, through the catalytic converter and through the second heat exchanger.

17. The system of claim 16, further comprising:

the exhaust gas discharge structure is adapted and configured to communicate with the gas turbine where the gas turbine is operating in a simple cycle.

18. The system of claim 16, further comprising:

the exhaust gas discharge structure is adapted and configured to communicate with a gas turbine operating in a simple cycle and to receive exhaust gas from the gas turbine operating in the simple cycle, and the exhaust gas discharge structure is adapted and configured to direct the exhaust gas received from the gas turbine operating in the simple cycle through the first heat exchanger, through the catalytic converter and through the second heat exchanger.

19. The system of claim 10, further comprising:

the cooling loop comprising a first conduit, the first conduit is adapted and configured to communicate the working fluid from the first heat exchanger to the district heating system;

the cooling loop comprising a second conduit, the second conduit is adapted and configured to communicate the working fluid from the district heating system to a pump;

the cooling loop comprising a third conduit, the third conduit is adapted and configured to communicate the working fluid from the pump to the second heat exchanger; and the cooling loop comprising a fourth conduit, the fourth conduit is adapted and configured to communicate the working fluid from the second heat exchanger to the first heat exchanger.

20. A system for treating exhaust gas comprising:

an exhaust gas discharge structure, the exhaust gas discharge structure is adapted and configured to receive a flow of exhaust gas from a gas turbine and direct the flow of exhaust gas through the exhaust gas discharge structure;

a first heat exchanger in the exhaust gas discharge structure, the first heat exchanger is adapted and configured to receive the flow of exhaust gas directed through the exhaust gas discharge structure and cool the flow of exhaust gas as the flow of exhaust gas passes through the first heat exchanger;

a first catalytic converter in the exhaust gas discharge structure, the first catalytic converter is adapted and configured to receive the flow of exhaust gas directed through the exhaust gas discharge structure from the first heat exchanger and reduce certain emissions from the flow of exhaust gas received from the first heat exchanger as the flow of exhaust gas passes through the first catalytic converter;

a second heat exchanger in the exhaust gas discharge structure, the second heat exchanger is adapted and configured to receive the flow of exhaust gas directed through the exhaust gas discharge structure from the catalytic converter and cool the flow of exhaust gas as the flow of exhaust gas passes through the second heat exchanger;

a second catalytic converter in the exhaust gas discharge structure, the second catalytic converter is adapted and configured to receive the flow of exhaust gas directed through the exhaust gas discharge structure that has been cooled by the second heat exchanger, the second catalytic converter is adapted and configured to reduce certain gas emissions from the flow of exhaust gas received from the second heat exchanger as the flow of exhaust gas passes through the second catalytic converter;

a district heating system outside the exhaust gas discharge structure and outside the flow of exhaust gas directed through the exhaust gas discharge structure; and a cooling loop, the cooling loop is adapted and configured to receive a flow of working fluid from the first heat exchanger and direct the flow of working fluid from the first heat exchanger to the district heating system, and the cooling loop is adapted and configured to receive the flow of working fluid from the district heating system and direct the flow of working fluid from the district heating system to the second heat exchanger, and the cooling loop is adapted and configured to receive the flow of working fluid from the second heat exchanger and direct the flow of working fluid from the second heat exchanger to the first heat exchanger.

21. The system of claim 20, further comprising:

the cooling loop comprising a first conduit, the first conduit is adapted and configured to communicate the working fluid from the first heat exchanger to the district heating system;

the cooling loop comprising a second conduit, the second conduit is adapted and configured to communicate the working fluid from the district heating system to a pump;

the cooling loop comprising a third conduit, the third conduit is adapted and configured to communicate the working fluid from the pump to the second heat exchanger; and the cooling loop comprising a fourth conduit, the fourth conduit is adapted and configured to communicate the working fluid from the second heat exchanger to the first heat exchanger.

22. The system of claim 21, further comprising:

a pump, the pump is connected in the cooling loop in fluid communication with the flow of working fluid directed through the cooling loop.

23. A method for treating gas turbine exhaust gas flowing through an exhaust gas discharge structure comprising:

directing a flow of exhaust gas from a gas turbine through a first heat exchanger located at least partially within the exhaust gas discharge structure and transferring heat from the flow of exhaust gas directed through the first heat exchanger to working fluid passing through the first heat exchanger;

directing the flow of exhaust gas from the first heat exchanger through a catalytic converter located within the exhaust gas discharge structure and reducing certain gas emissions from the flow of exhaust gas directed through the catalytic converter;

directing the flow of exhaust gas with certain gas emissions reduced from the catalytic converter through a second heat exchanger located within the exhaust gas discharge structure and transferring heat from the flow of exhaust gas directed through the second heat exchanger to working fluid passing through the second heat exchanger;

connecting the first heat exchanger and the second heat exchanger in a cooling loop with a district heating system, the district heating system being located outside of the exhaust gas discharge structure; and cycling the working fluid in the cooling loop from the first heat exchanger, through the district heating system, through the second heat exchanger and to the first heat exchanger.

24. The method of claim 23, further comprising:

the catalytic converter being a first catalytic converter; and directing the flow of exhaust gas from the second heat exchanger through a second catalytic converter located within the exhaust gas discharge structure and reducing certain gas emissions from the flow of exhaust gas received from the second heat exchanger and directed through the second catalytic converter.

25. The method of claim 23, further comprising:

heating the working fluid from heat transferred to the working fluid from the first heat exchanger; and transferring heat from the working fluid to the district heating system by cycling the working fluid in the cooling loop from the first heat exchanger to the district heating system.

26. The method of claim 23, further comprising:

a pump being positioned in the cooling loop and operating the pump to cycle the working fluid in the cooling loop.

* * * * *